US010788261B2

(12) United States Patent
Krishnamurthy et al.

(10) Patent No.: US 10,788,261 B2
(45) Date of Patent: Sep. 29, 2020

(54) METHOD AND SYSTEM FOR COOLING A HYDROCARBON STREAM USING A GAS PHASE REFRIGERANT

(71) Applicant: Air Products and Chemicals, Inc., Allentown, PA (US)

(72) Inventors: Gowri Krishnamurthy, Sellersville, PA (US); Mark Julian Roberts, Kempton, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 54 days.

(21) Appl. No.: 15/964,377

(22) Filed: Apr. 27, 2018

(65) Prior Publication Data

US 2019/0331414 A1 Oct. 31, 2019

(51) Int. Cl.

| | |
|---|---|
| ***F25J 1/00*** | (2006.01) |
| ***F25B 9/06*** | (2006.01) |
| ***F25J 1/02*** | (2006.01) |

(52) U.S. Cl.

CPC ..... *F25J 1/0047* (2013.01); *F25J 1/0022* (2013.01); *F25J 1/0082* (2013.01); *F25J 1/0204* (2013.01);

(Continued)

(58) Field of Classification Search

CPC .... F28B 2001/065; F25J 2200/04; F25J 1/00; F25J 1/0022; F25J 1/0082; F25J 1/0204; F25J 1/0221; F25J 1/0223; F25J 2270/60; F25J 2270/66; F25J 2270/90; F17C 2227/0369; F17C 2227/0372; F28F 2225/02; F28F 2230/00; F25B 9/06; F25B 9/10

See application file for complete search history.

(56) References Cited

U.S. PATENT DOCUMENTS

| | | | |
|---|---|---|---|
| 3,162,519 | A | 12/1964 | Peters et al. |
| 3,616,652 | A | 11/1971 | Engel |

(Continued)

FOREIGN PATENT DOCUMENTS

| | | |
|---|---|---|
| CN | 105823304 | 8/2016 |
| DE | 1268161 | 5/1968 |
| DE | 102006039889 | 2/2008 |

OTHER PUBLICATIONS

James C. Bronfenbrenner, et al, "Selecting a suitable process", Review the process technology options available for the liquefaction of natural gas, Summer 09, lngindustry.com.

(Continued)

*Primary Examiner* — Frantz F Jules
*Assistant Examiner* — Erik Mendoza-Wilkenfel
(74) *Attorney, Agent, or Firm* — Amy Carr-Trexler

(57) ABSTRACT

Described herein are methods and systems for the liquefaction of a natural gas feed stream using a refrigerant comprising methane. The methods and systems use a refrigeration circuit and cycle that employs two or more turboexpanders to expand two or more streams of gaseous refrigerant down to different pressures to provide cold streams of at least predominantly gaseous refrigerant at different pressures that are used to provide refrigeration for precooling and liquefying the natural gas. The resulting liquefied natural gas stream is then flashed to produce an LNG product and a flash gas, the flash gas being recycled to the natural gas feed stream.

18 Claims, 5 Drawing Sheets

(52) U.S. Cl.
CPC ..... *F25J 1/0221* (2013.01); *F25J 1/0223* (2013.01); *F25J 2270/60* (2013.01)

(56) References Cited

U.S. PATENT DOCUMENTS

| | | | | |
|---|---|---|---|---|
| 4,541,852 | A | 9/1985 | Newton et al. | |
| 4,778,497 | A | 10/1988 | Hanson et al. | |
| 5,916,260 | A * | 6/1999 | Dubar | F25J 1/0022 62/613 |
| 6,351,969 | B1 * | 3/2002 | Arman | F25J 3/04048 62/643 |
| 6,412,302 | B1 | 7/2002 | Foglietta | |
| 6,446,465 | B1 * | 9/2002 | Dubar | F25J 1/0022 62/612 |
| 6,658,890 | B1 | 12/2003 | Hahn et al. | |
| 7,234,321 | B2 | 6/2007 | Maunder et al. | |
| 7,581,411 | B2 | 9/2009 | Mostello | |
| 8,464,551 | B2 | 6/2013 | Roberts et al. | |
| 8,656,733 | B2 | 2/2014 | Roberts et al. | |
| 9,163,873 | B2 | 10/2015 | Jakobsen et al. | |
| 2005/0056051 | A1 * | 3/2005 | Roberts | F25J 1/0022 62/612 |
| 2009/0282862 | A1 | 11/2009 | Chantant et al. | |
| 2010/0175425 | A1 * | 7/2010 | Walther | F25J 1/0022 62/623 |
| 2010/0223951 | A1 * | 9/2010 | Jager | F25J 1/0042 62/613 |
| 2010/0281915 | A1 | 11/2010 | Roberts et al. | |
| 2011/0113825 | A1 | 5/2011 | Neeraas et al. | |
| 2011/0203312 | A1 | 8/2011 | Jakobsen et al. | |
| 2011/0226008 | A1 | 9/2011 | Gushanas et al. | |
| 2014/0083132 | A1 | 3/2014 | Maunder et al. | |
| 2014/0245780 | A1 | 9/2014 | Wyllie et al. | |
| 2015/0135734 | A1 * | 5/2015 | Carlander-Reuterfelt | F17C 13/082 62/53.2 |
| 2015/0204603 | A1 * | 7/2015 | Sheng | F25J 1/0022 62/614 |
| 2016/0054053 | A1 | 2/2016 | Bauer et al. | |
| 2016/0313057 | A1 | 10/2016 | Roberts et al. | |
| 2016/0327335 | A1 | 11/2016 | Brostow et al. | |

OTHER PUBLICATIONS

Karlheinz Mueller, et al, "Erdgasverfluessigung durch einen Expansionsturbinen-Gemischkreislaufll", Linde Berichte Aus Tech:Und Wissenschaft, vol. 30, Jun. 1, 1976, pp. 36-41.

Pierre Rabeau, et al, "How to Reduce CO2 Emissions in the LNG Chain", International Conference and Exhibition on Liquefied Natural Gas, vol. 15, Apr. 24, 2007, pp. PS2-PS7.

* cited by examiner

METHOD AND SYSTEM FOR COOLING A HYDROCARBON STREAM USING A GAS PHASE REFRIGERANT

BACKGROUND

The present invention relates to a method and system for liquefying a natural gas feed stream to produce a liquefied natural gas (LNG) product.

The liquefaction of natural gas is an important industrial process. The worldwide production capacity for LNG is more than 300 MTPA, and a variety of refrigeration cycles for liquefying natural gas have been successfully developed, and are known and widely used in the art.

Some cycles utilize a vaporizing refrigerant to provide the cooling duty for liquefying the natural gas. In these cycles, the initially gaseous, warm refrigerant (which may, for example, be a pure, single component refrigerant, or a mixed refrigerant) is compressed, cooled and liquefied to provide a liquid refrigerant. This liquid refrigerant is then expanded so as to produce a cold vaporizing refrigerant that is used to liquefy the natural gas via indirect heat exchange between the refrigerant and natural gas. The resulting warmed vaporized refrigerant can then be compressed to start the cycle again. Exemplary cycles of this type that are known and used in the art include the single mixed refrigerant (SMR) cycle, cascade cycle, dual mixed refrigerant (DMR) cycle, and propane pre-cooled mixed refrigeration (C3MR) cycle.

Other cycles utilize a gaseous expansion cycle to provide the cooling duty for liquefying the natural gas. In these cycles, the gaseous refrigerant does not change phase during the cycle. The gaseous warm refrigerant is compressed and cooled to form a compressed refrigerant. The compressed refrigerant is then expanded to further cool the refrigerant, resulting in an expanded cold refrigerant that is then used to liquefy the natural gas via indirect heat exchange between the refrigerant and natural gas. The resulting warmed expanded refrigerant can then be compressed to start the cycle again.

Exemplary cycles of this type that are known and used in the art are Reverse Brayton cycles, such as the nitrogen expander cycle and the methane expander cycle.

Further discussion of the established nitrogen expander cycle, cascade, SMR and C3MR processes and their use in liquefying natural gas can, for example, be found in "Selecting a suitable process", by J. C. Bronfenbrenner, M. Pillarella, and J. Solomon, *Review the process technology options available for the liquefaction of natural gas*, summer 09, LNGINDUSTRY.COM A current trend in the LNG industry is to develop remote offshore gas fields, which will require a system for liquefying natural gas to be built on a floating platform, such applications also being known in the art as Floating LNG (FLNG) applications. Designing and operating such a LNG plant on a floating platform poses, however, a number of challenges that need to be overcome. Motion on the floating platform is one of the main challenges. Conventional liquefaction processes that use mixed refrigerant (MR) involve two-phase flow and separation of the liquid and vapour phases at certain points of the refrigeration cycle, which may lead to reduced performance due to liquid-vapor maldistribution if employed on a floating platform. In addition, in any of the refrigeration cycles that employ a liquefied refrigerant, liquid sloshing may cause additional mechanical stresses. Storage of an inventory of flammable components is another concern for many LNG plants that employ refrigeration cycles because of safety considerations.

Another trend in the industry is the development smaller scale liquefaction facilities, such as in the case of peak shaving facilities, or modularized liquefaction facilities where multiple lower capacity liquefaction trains are used instead of a single high capacity train. It is desirable to develop liquefaction cycles that have high process efficiency at lower capacities.

As a result, there is an increasing need for the development of a process for liquefying natural gas that involves minimal two-phase flow, requires minimal flammable refrigerant inventory, and has high process efficiency.

The nitrogen recycle expander process is, as noted above, a well-known process that uses gaseous nitrogen as refrigerant. This process eliminates the usage of mixed refrigerant, and hence it represents an attractive alternative for FLNG facilities and for land-based LNG facilities which require minimum hydrocarbon inventory. However, the nitrogen recycle expander process has a relatively lower efficiency and involves larger heat exchangers, compressors, expanders and pipe sizes. In addition, the process depends on the availability of relatively large quantities of pure nitrogen.

U.S. Pat. Nos. 8,656,733 and 8,464,551 teach liquefaction methods and systems in which a closed-loop gaseous expander cycle, using for example gaseous nitrogen as the refrigerant, is used to liquefy and sub-cool a feed stream, such as for example a natural gas feed stream. The described refrigeration circuit and cycle employs a plurality turbo-expanders to produce a plurality of streams of expanded cold gaseous refrigerant, with the refrigerant stream that subcools the natural gas being let down to a lower pressure and temperature than the refrigerant stream that is used to liquefy the natural gas.

US 2016/054053 and U.S. Pat. No. 7,581,411 teach processes and systems for liquefying a natural gas stream, in which a refrigerant, such as nitrogen, is expanded to produce a plurality of refrigerant streams at comparable pressures. The refrigerant streams streams used for precooling and liquefying the natural gas are gaseous streams that are expanded in turbo-expanders, while the refrigerant stream used for subcooling the natural gas is at least partially liquefied before being expanded through a J-T valve.

All the streams of refrigerant are let down to the same or approximately the same pressure and are mixed as they pass through and are warmed in the various heat exchanger sections, so as to form a single warm stream that is introduced into a shared compressor for recompression.

U.S. Pat. No. 9,163,873 teaches a process and system for liquefying a natural gas stream in which a plurality of turbo-expanders are used to expand a gaseous refrigerant, such a nitrogen, to produce a plurality of streams of cold expanded gaseous refrigerant, at different pressures and temperatures. As in U.S. Pat. Nos. 8,656,733 and 8,464,551, the lowest pressure and temperature stream is used for sub-cooling the natural gas.

US 2016/0313057 A1 teaches methods and systems for liquefying a natural gas feed stream having particular suitability for FLNG applications. In the described methods and systems, a gaseous methane or natural gas refrigerant is expanded in a plurality of turbo-expanders to provide cold expanded gaseous streams of refrigerant that are used for precooling and liquefying the natural gas feed stream. All the streams of refrigerant are let down to the same or approximately the same pressure and are mixed as they pass through and are warmed in the various heat exchanger sections, so as to form a single warm stream that is introduced into a shared compressor for recompression. The liquefied natural gas feed stream is subjected to various flash stages to further cool the natural gas in order to obtain the LNG product.

Nevertheless, there remains a need in the art for methods and systems for liquefying natural gas that utilize refrigeration cycles with high process efficiency that are suitable for use in FLNG applications, peak shaving facilities, and other scenarios where two-phase flow of refrigerant and separation of two-phase refrigerant is not preferred, maintenance of a large inventory of flammable refrigerant may be problematic, large quantiles of pure nitrogen or other required refrigerant components may be unavailable or difficult to obtain, and/or the available footprint for the plant places restrictions on the size of the heat exchangers, compressors, expanders and pipes that can be used in the refrigeration circuit.

BRIEF SUMMARY

Disclosed herein are methods and systems for the liquefaction of a natural gas feed stream to produce an LNG product. The methods and systems use a refrigeration circuit that circulates a refrigerant comprising methane. The refrigeration circuit includes first and second turbo-expanders that are used to expand gaseous streams of the refrigerant down to different pressures to provide expanded cold streams of gaseous or at least predominantly gaseous refrigerant at different pressures that are then used to provide refrigeration for precooling and liquefying the natural gas, wherein the stream of refrigerant that is used for liquefying the gas is at a lower pressure than the stream of refrigerant that is used for precooling the natural gas. The resulting stream of liquefied natural gas is then flashed to form a flash gas stream and the LNG product, with the flash gas stream being recycled back into the natural gas feed stream. Such methods and systems provide for the production of an LNG product utilizing a refrigeration cycle with high process efficiency, that uses a refrigerant (methane) that is available on-site, and in which the refrigerant remains or predominatly remains in gaseous form throughout the refrigeration cycle.

Several preferred aspects of the systems and methods according to the present invention are outlined below.

Aspect 1: A method for liquefying a natural gas feed stream to produce an LNG product, the method comprising:

(a) passing a first natural gas feed stream through and cooling the first natural gas feed stream in the warm side of some or all of a plurality of heat exchanger sections so as to precool and liquefy the first natural gas feed stream, the plurality of heat exchanger sections comprising a first heat exchanger section in which a natural gas stream is precooled and a second heat exchanger section in which the precooled natural gas stream from the first heat exchanger section is liquefied to form a first liquefied natural gas stream;

(b) flashing the first liquefied natural gas stream withdrawn from the second heat exchanger section to form a flash gas and an LNG product, and separating the flash gas from the LNG product so as to form a flash gas stream and an LNG product stream;

(c) compressing the flash gas stream and recycling the compressed flash gas back into the first natural gas feed stream;

(d) circulating a refrigerant, comprising methane, in a refrigeration circuit comprising the plurality of heat exchanger sections, a compressor train comprising a plurality of compressors and/or compression stages and one or more intercoolers and/or aftercoolers, a first turbo-expander and a second turbo-expander, wherein the circulating refrigerant provides refrigeration to each of the plurality of heat exchanger sections and thus cooling duty for precooling and liquefying the first natural gas feed stream, and wherein circulating the refrigerant in the refrigerant circuit comprises the the steps of:

(i) splitting a compressed and cooled gaseous stream of the refrigerant to form a first stream of cooled gaseous refrigerant and a second stream of cooled gaseous refrigerant;

(ii) expanding the first stream of cooled gaseous refrigerant down to a first pressure in the first turbo-expander to form a first stream of expanded cold refrigerant at a first temperature and said first pressure, the first stream of expanded cold refrigerant being a gaseous or predominantly gaseous stream containing no or substantially no liquid as it exits the first turbo-expander;

(iii) passing the second stream of cooled gaseous refrigerant through and cooling the second stream of cooled gaseous refrigerant in the warm side of at least one of the plurality of heat exchanger sections, so as to further cool the second stream of cooled gaseous refrigerant;

(iv) expanding the further cooled second stream of cooled gaseous refrigerant down to a second pressure in the second turbo-expander to form a second stream of expanded cold refrigerant at a second temperature and said second pressure, the second stream of expanded cold refrigerant being a gaseous or predominantly gaseous stream containing no or substantially no liquid as it exits the second turbo-expander, the second pressure being lower than the first pressure and the second temperature being lower than the first temperature; (v) passing the first stream of expanded cold refrigerant through and warming the first stream of expanded cold refrigerant in the cold side of at least one of the plurality of heat exchanger sections, comprising at least the first heat exchanger section and/or a heat exchanger section in which all or part of the second stream of cooled gaseous refrigerant is cooled, and passing the second stream of expanded cold refrigerant through and warming the second stream of expanded cold refrigerant in the cold side at least one of the plurality of heat exchanger sections, comprising at least the second heat exchanger section, wherein the first and second streams of expanded cold refrigerant are kept separate and not mixed in the cold sides of any of the plurality of heat exchanger sections, the first stream of expanded cold refrigerant being warmed to form a first stream of warmed gaseous refrigerant and the second stream of expanded cold refrigerant being warmed to form a second stream of warmed gaseous refrigerant; and (vi) introducing the first stream of warmed gaseous refrigerant and the second stream of warmed gaseous refrigerant into the compressor train, whereby the second stream of warmed gaseous refrigerant is introduced into compressor train at a different, lower pressure location of the compressor train than the first stream of warmed gaseous refrigerant, and compressing, cooling and combining the first stream of warmed gaseous refrigerant and second stream of warmed gaseous refrigerant to form the compressed and cooled gaseous stream of the refrigerant that is split in step (i).

Aspect 2: The method of Aspect 1, wherein the refrigerant comprises at least 85 mole % methane.

Aspect 3: The method of Aspect 1 or 2, wherein the first stream of expanded cold refrigerant has a vapor fraction of equal to or greater than 0.8 as it exits the first turbo-expander, and wherein the second stream of expanded cold refrigerant has a vapor fraction of equal to or greater than 0.8 as it exits the second turbo-expander.

Aspect 4: The method of any one of Aspects 1 to 3, wherein the pressure ratio of the first pressure to the second pressure is from 1.5:1 to 2.5:1.

Aspect 5: The method of any one of Aspects 1 to 4, wherein the first liquefied natural gas stream is withdrawn from the second heat exchanger at a temperature of −100 to −145° C.

Aspect 6: The method of any one of Aspects 1 to 4, wherein the first liquefied natural gas stream is withdrawn from the second heat exchanger at a temperature of −110 to −145° C.

Aspect 7: The method of any one of Aspects 1 to 6, wherein the refrigeration circuit is a closed-loop refrigeration circuit.

Aspect 8: The method of any one of Aspects 1 to 7, wherein the method further comprises recovering cold from the flash gas stream, prior to compressing the flash gas stream and recycling the compressed flash gas, by passing the flash gas stream through and warming the flash gas stream in the cold side of a flash gas heat exchanger section.

Aspect 9: The method of Aspect 8, wherein the flash gas heat exchanger section is not one of the plurality of heat exchanger sections of the refrigeration circuit that are provided with refrigeration by the circulating refrigerant.

Aspect 10: The method of Aspect 8 or 9, wherein the method further comprises:

(e) passing a second natural gas feed stream through and cooling and liquefying the second natural gas feed stream in the warm side of the flash gas heat exchanger section so as to form a second liquefied natural gas stream; and (f) flashing the second liquefied natural gas stream withdrawn from the flash gas heat exchanger section to form additional flash gas and additional LNG product, and separating the additional flash gas from the additional LNG product so as to provide additional flash gas for the flash gas stream and additional LNG product for the LNG product stream.

Aspect 11: The method of Aspect 10, wherein in steps (b) and (f) the separation of the flash gas and additional flash gas from the LNG product and additional LNG product takes place by introducing the flashed first liquefied natural gas stream and flashed second liquefied natural gas stream into a vapor-liquid separator in which the streams are together separated into a vapor overhead and liquid bottoms, the vapor overhead being withdrawn to form the flash gas stream and the liquid bottoms being withdrawn to form the LNG product stream.

Aspect 12: The method of any one of Aspects 1 to 11, wherein the second heat exchanger section is a coil wound heat exchanger section comprising a tube bundle having tube-side and a shell side.

Aspect 13: The method of any one of Aspects 1 to 12, wherein the first heat exchanger section has a cold side that defines a plurality of separate passages through the heat exchanger section, and wherein the first stream of expanded cold refrigerant passes through and is warmed in at least one of said passages through the first heat exchanger section to form the first stream of warmed gaseous refrigerant, and the second stream of expanded cold refrigerant passes through and is warmed in the cold side of the second heat exchanger section and then passes through and is further warmed in at least one or more other of said passages through the first heat exchanger section to form the second stream of warmed gaseous refrigerant.

Aspect 14: The method of any one of Aspects 1 to 12, wherein wherein the first heat exchanger section is a coil wound heat exchanger section comprising a tube bundle having tube-side and a shell side, the plurality of heat exchanger sections further comprise a third heat exchanger section in which a natural gas stream is precooled and/or in which all or a part of the second stream of cooled gaseous refrigerant is cooled, the first stream of expanded cold refrigerant passes through and is warmed in the cold side of one of the first and third heat exchanger sections to form the first stream of warmed gaseous refrigerant, and the second stream of expanded cold refrigerant passes through and is warmed in the cold side of the second heat exchanger section and then passes through and is further warmed in the cold side of the other of the third and first heat exchanger sections to form the second stream of warmed gaseous refrigerant.

Aspect 15: A system for liquefying a natural gas feed stream to produce an LNG product, the system comprising:

(a) a refrigeration circuit for circulating a refrigerant that provides refrigeration to each of a plurality of heat exchanger sections and thus cooling duty for precooling and liquefying a first natural gas feed stream, the refrigeration circuit comprising:

the plurality of heat exchanger sections, each of the heat exchanger sections having a warm side and a cold side, the plurality of heat exchanger sections comprising a first heat exchanger section and a second heat exchanger section, wherein the warm side of the first heat exchanger defines at least one passage therethrough for receiving and precooling a natural gas stream, wherein the warm side of the second heat exchanger section defines at least one passage therethrough for receiving and liquefying the precooled natural gas stream from the first heat exchanger section so as to form a first liquefied natural gas stream, and wherein the cold side of each of the plurality of heat exchanger sections defines at least one passage therethrough for receiving and warming an expanded stream of the circulating refrigerant;

a compressor train, comprising a plurality of compressors and/or compression stages and one or more intercoolers and/or aftercoolers, for compressing and cooling the circulating refrigerant, wherein the refrigeration circuit is configured such that the compressor train receives a first stream of warmed gaseous refrigerant and a second stream of warmed gaseous refrigerant from the plurality of heat exchanger sections, the second stream of warmed gaseous refrigerant being received at and introduced into a different, lower pressure location of the compressor train than the first stream of warmed gaseous refrigerant, the compressor train being configured to compress, cool and combine the first stream of warmed gaseous refrigerant and second stream of warmed gaseous refrigerant to form a compressed and cooled gaseous stream of the refrigerant;

a first turbo-expander configured to receive and expand a first stream of cooled gaseous refrigerant down to a first pressure to form a first stream of expanded cold refrigerant at a first temperature and said first pressure;

a second turbo-expander configured to receive and expand a further cooled second stream of cooled gaseous refrigerant down to a second pressure to form a second stream of expanded cold refrigerant at a second temperature and said second pressure, the second pressure being lower than the first pressure and the second temperature being lower than the first temperature;

wherein the refrigeration circuit is further configured so as to:

split the compressed and cooled gaseous stream of the refrigerant from the compressor train to form the first stream of cooled gaseous refrigerant and a second stream of cooled gaseous refrigerant;

pass the second stream of cooled gaseous refrigerant through and cool the second stream of cooled gaseous refrigerant in the warm side of at least one of the plurality of heat exchanger sections, so as to form the further cooled second stream of cooled gaseous refrigerant; and pass the first stream of expanded cold refrigerant through and warm the first stream of expanded cold refrigerant in the cold side of at least one of the plurality of heat exchanger sections, comprising at least the first heat exchanger section and/or a heat exchanger section in which all or part of the second stream of cooled gaseous refrigerant is cooled, and pass the second stream of expanded cold refrigerant through and warm the second stream of expanded cold refrigerant in the cold side at least one of the plurality of heat exchanger sections, comprising at least the second heat exchanger section, wherein the first and second streams of expanded cold refrigerant are kept separate and not mixed in the cold sides of any of the plurality of heat exchanger sections, the first stream of expanded cold refrigerant being warmed to form the first stream of warmed gaseous refrigerant and the second stream of expanded cold refrigerant being warmed to form the second stream of warmed gaseous refrigerant;

(b) a pressure reducing device configured to receive the first liquefied natural gas stream from the second heat exchanger section of the plurality of heat exchanger sections and flash the first liquefied natural gas stream to form a flash gas and an LNG product;

(c) a vapor-liquid separator configured to separate the flash gas from the LNG product so as to form a flash gas stream and an LNG product stream; and (d) a flash gas compressor for receiving and compressing the flash gas stream and recycling the compressed flash gas back into the first natural gas feed stream.

Aspect 16: A system according to Aspect 15, wherein the system further comprises:

(e) a flash gas heat exchanger section for recovering cold from the flash gas stream prior to the flash gas stream being received and compressed by the flash gas compressor, the flash gas heat exchanger section having a warm side and a cold side, wherein the cold side defines one or more passages therethrough for receiving and warming the flash gas stream.

Aspect 17: A system according to Aspect 16, wherein the warm side of the flash gas heat exchanger defines one or more passages therethrough for receiving, cooling and liquefying a second natural gas feed stream so as to form a second liquefied natural gas stream.

Aspect 18: A system according to Aspect 17, wherein the system further comprises:

(e) a pressure reducing device configured to receive the second liquefied natural gas stream from the flash gas heat exchanger and flash the second liquefied natural gas stream to form additional flash gas and additional LNG product; and wherein the vapor-liquid separator is configured to separate also the additional flash gas from the additional LNG product so as to provide additional flash gas for the flash gas stream and additional LNG product for the LNG product stream.

DETAILED DESCRIPTION

Figure 1:
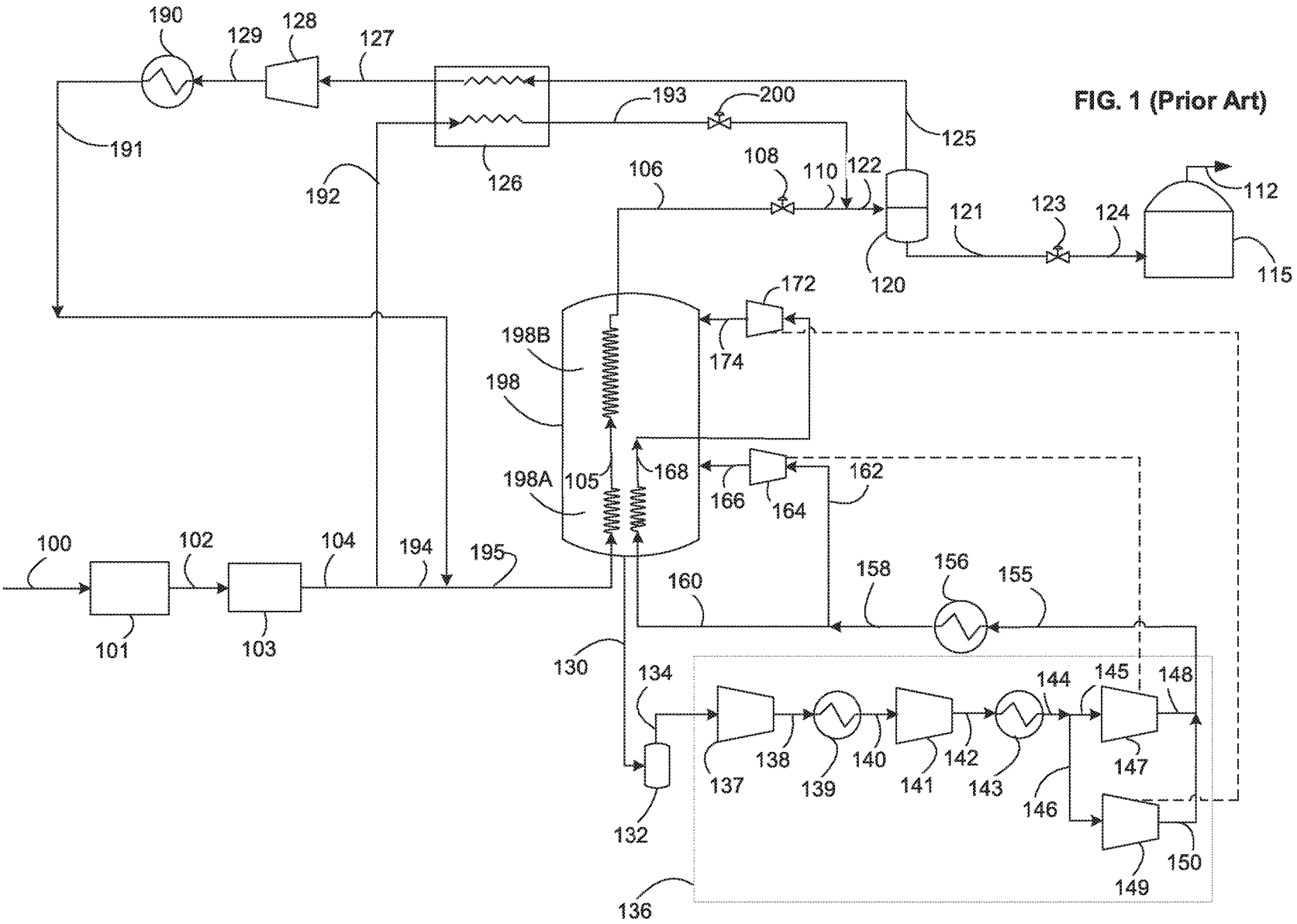
FIG. 1 (Prior Art)
FIG. 1 is a schematic flow diagram depicting a natural gas liquefaction method and system in accordance with the prior art.

Described herein are methods and systems for liquefying a natural gas that are particularly suitable and attractive for Floating LNG (FLNG) applications, peak shaving applications, modular liquefaction facilities, small scale facilities, and/or any other applications in which: high process efficiency is desired; two-phase flow of refrigerant and separation of two-phase refrigerant is not preferred; maintenance of a large inventory of flammable refrigerant is problematic; large quantiles of pure nitrogen or other required refrigerant components are unavailable or difficult to obtain; and/or the available footprint for the plant places restrictions on the size of the heat exchangers, compressors, expanders and pipes that can be used in the refrigeration system.

As used herein and unless otherwise indicated, the articles "a" and "an" mean one or more when applied to any feature in embodiments of the present invention described in the specification and claims. The use of "a" and "an" does not limit the meaning to a single feature unless such a limit is specifically stated. The article "the" preceding singular or plural nouns or noun phrases denotes a particular specified feature or particular specified features and may have a singular or plural connotation depending upon the context in which it is used.

Where letters are used herein to identify recited steps of a method (e.g. (a), (b), and (c)), these letters are used solely to aid in referring to the method steps and are not intended to indicate a specific order in which claimed steps are performed, unless and only to the extent that such order is specifically recited.

Where used herein to identify recited features of a method or system, the terms "first", "second", "third" and so on, are used solely to aid in referring to and distinguishing between the features in question, and are not intended to indicate any specific order of the features, unless and only to the extent that such order is specifically recited.

As used herein, the terms "natural gas" and "natural gas stream" encompass also gases and streams comprising synthetic and/or substitute natural gases. The major component of natural gas is methane (which typically comprises at least 85 mole %, more often at least 90 mole %, and on average about 95 mole % of the feed stream). Natural gas may also contain smaller amounts of other, heavier hydrocarbons, such as ethane, propane, butanes, pentanes, etc. Other typical components of raw natural gas include one or more components such as nitrogen, helium, hydrogen, carbon dioxide and/or other acid gases, and mercury. However, the natural gas feed stream processed in accordance with the present invention will have been pre-treated if and as necessary to reduce the levels of any (relatively) high freezing point components, such as moisture, acid gases, mercury and/or heavier hydrocarbons, down to such levels as are necessary to avoid freezing or other operational problems in the heat exchanger section or sections in which the natural gas is to be liquefied.

As used herein, the term "refrigeration cycle" refers the series of steps that a circulating refrigerant undergoes in order to provide refrigeration to another fluid, and the term "refrigeration circuit" refers to the series of connected devices in which the refrigerant circulates and that carry out the aforementioned steps of the refrigeration cycle. In the methods and systems described herein, the refrigeration circuit comprises a plurality of heat exchanger sections, in which the circulating refrigerant is warmed to provide refrigeration, a compressor train comprising a plurality of compressors and/or compression stages and one or more intercoolers and/or aftercoolers, in which the circulating refrigerant is compressed and cooled, and at least two turbo-expanders, in which the circulating refrigerant is expanded to provide a cold refrigerant for supply to the plurality of heat exchanger sections.

As used herein, the term "heat exchanger section" refers to a unit or a part of a unit in which indirect heat exchange is taking place between one or more streams of fluid flowing through the cold side of the heat exchanger and one or more streams of fluid flowing through the warm side of the heat exchanger, the stream(s) of fluid flowing through the cold side being thereby warmed, and the stream(s) of fluding flowing the warm side being thereby cooled.

As used herein, the term "indirect heat exchange" refers to heat exchange between two fluids where the two fluids are kept separate from each other by some form of physical barrier.

As used herein, the term "warm side" as used to refer to part of a heat exchanger section refers to the side of the heat exchanger through which the stream or streams of fluid pass that are to be cooled by indirect heat exchange with the fluid flowing through the cold side. The warm side may define a single passage through the heat exchanger section for receiving a single stream of fluid, or more than one passage through the heat exchanger section for receiving multiple streams of the same or different fluids that are kept separate from each other as they pass through the heat exchanger section.

As used herein, the term "cold side" as used to refer to part of a heat exchanger section refers to the side of the heat exchanger through which the stream or streams of fluid pass that are to be warmed by indirect heat exchange with the fluid flowing through the warm side. The cold side may define a single passage through the heat exchanger section for receiving a single stream of fluid, or more than one passage through the heat exchanger section for receiving multiple streams of fluid that are kept separate from each other as they pass through the heat exchanger section.

As used herein, the term "coil wound heat exchanger" refers to a heat exchanger of the type known in the art, comprising one or more tube bundles encased in a shell casing, wherein each tube bundle may have its own shell casing, or wherein two or more tube bundles may share a common shell casing. Each tube bundle may represent a "coil wound heat exchanger section", the tube side of the bundle representing the warm side of said section and defining one or more than one passage through the section, and the shell side of the bundle representing the cold side of said section defining a single passage through the section. Coil wound heat exchangers are a compact design of heat exchanger known for their robustness, safety, and heat transfer efficiency, and thus have the benefit of providing highly efficient levels of heat exchange relative to their footprint. However, because the shell side defines only a single passage through the heat exchanger section, it is not possible use more than one stream of refrigerant in the cold side (shell side) of each coil wound heat exchanger section without said streams of refrigerant mixing in the cold side of said heat exchanger section.

As used herein, the term "turbo-expander" refers to a centrifugal, radial or axial-flow turbine, in and through which a gas is work-expanded (expanded to produce work) thereby lowering the pressure and temperature of the gas. Such devices are also referred to in the art as expansion turbines. The work produced by the turbo-expander may be used for any desired purpose. For example, it may be used to drive a compressor (such as one or more compressors or compression stages of the refrigerant compressor train) and/or to drive a generator.

As used herein, the term "flashing" (also referred to in the art as "flash evaporating") refers to the process of reducing the pressure of a liquid or two-phase (i.e. gas-liquid) stream so as to partially vaporize the stream, thereby generating a "flashed" stream that is a two-phase stream that is reduced in pressure and temperature. The vapor (i.e. gas) present in the flashed stream is referred to herein as the "flash gas". A liquid or two-phase stream may flashed by passing the stream through any pressure reducing device suitable for reducing the pressure of and thereby partially vaporizing the stream, such for example a J-T valve or a hydraulic turbine (or other work expansion device).

As used herein, the term "J-T" valve or "Joule-Thomson valve" refers to a valve in and through which a fluid is throttled, thereby lowering the pressure and temperature of the fluid via Joule-Thomson expansion.

As used herein, the term "vapor-liquid separator" refers to vessel, such as but not limited to a flash drum or knock-out drum, into which a two phase stream can be introduced in order to separate the stream into its constituent vapor and liquid phases, whereby the vapor phase collects at and can be withdrawn from the top of the vessel and the liquid phase collects at and can be withdrawn from the bottom of the vessel. The vapor that collects at the top of the vessel is also referred to herein as the "overheads" or "vapor overhead", and the liquid that collects at the bottom of the vessel is also referred to herein as the "bottoms" or "bottom liquid". Where a J-T valve is being used to flash a liquid or two-phase stream, and a vapor-liquid separator (e.g. flash drum) is being used to separate the resulting flash gas and liquid, the valve and separator can be combined into a single device, such as for example where the valve is located in the inlet to the separator through which the liquid or two-phase stream is introduced.

As used herein, the terms "closed-loop cycle", "closed-loop circuit" and the like refer to a refrigeration cycle or circuit in which, during normal operation, refrigerant is not removed from the circuit or added to the circuit (other than to compensate for small unintentional losses such as through leakage or the like). As such, in a closed-loop refrigeration circuit if the fluids being cooled in the warm side of any of the heat exchanger sections comprise both a refrigerant stream and a stream of natural gas that is to be cooled and/or liquefied, said refrigerant stream and natural gas stream will be passed through separate passages in the warm side(s) of said heat heat exchanger section(s) such that said streams are kept separate and do not mix.

As used herein, the term "open-loop cycle", "open-loop circuit" and the like refer to a refrigerant cycle or circuit in which the feed stream that is to be liquefied, i.e. natural gas, also provides the circulating refrigerant, whereby during normal operation refrigerant is added to and removed from the circuit on a continuous basis. Thus, for example, in an open-loop cycle a natural gas stream may be introduced into the open-loop circuit as a combination of natural gas feed and make-up refrigerant, which natural gas stream is then combined with stream of warmed gaseous refrigerant to from the heat exchanger sections to form a combined stream that may then be compressed and cooled in the compressor train to form the compressed and cooled gaseous stream of refrigerant, a portion of which is subsequently split off to form the natural gas feed stream that is to be liquefied.

Solely by way of example, certain prior art arrangements and exemplary embodiments of the invention will now be described with reference to FIGS. 1 to 5. In these Figures, where a feature is common to more than one Figure that feature has been assigned the same reference numeral in each Figure, for clarity and brevity.

Referring now to FIG. 1, a natural gas liquefaction method and system in accordance with the prior art is shown. A raw natural gas feed stream 100 is optionally pretreated in a pretreatment system 101 to remove impurities such as mercury, water, acid gases, and heavy hydrocarbons and produce a pretreated natural gas feed stream 102, which may optionally be precooled in a precooling system 103 to produce a natural gas feed stream 104.

The natural gas feed stream 104 is split to form a first natural gas feed stream 194 and a second natural gas feed stream 192. A compressed flash gas stream 191 is recycled by being mixed with the first natural gas feed stream 194 prior to the resulting first natural gas stream 195 (containing also the recycled flash gas) being precooled and liquefied in a Main Cryogenic Heat Exchanger (MCHE) 198, as further described below. Alternatively, the compressed flashed gas stream 191 may be recycled by being mixed with the natural gas feed stream 104 prior to said stream being split to form into the first and second natural gas feed streams.

The first natural gas feed stream 195 is precooled and liquefied in a MCHE 198 that as depicted in FIG. 1 comprises two heat exchanger sections, namely a warm section 198A, in which the first natural gas feed stream is cooled to produce a precooled first natural gas feed stream 105, and a cold section 198B in which the precooled first natural gas feed stream 105 is further cooled and liquefied to produce a first liquefied natural gas stream 106. The first liquefied natural gas stream 106 is then flashed via throttling in a first J-T valve 108 to produce a flashed first liquefied natural gas stream 110.

The MCHE 198 may be any kind of heat exchanger such as a coil wound heat exchanger (as depicted in FIG. 1), a plate and fin heat exchanger, a shell and tube heat exchanger, or any other suitable type of heat exchanger known in the art. It may also consist of only one section, or three or more sections (rather than the two sections shown). These heat exchanger sections may be located within one common casing (as shown), or in separate heat exchangers casings.

The second natural gas feed stream 192 is cooled and liquefied in flash gas heat exchanger section 126 to produce a second liquefied natural gas stream 193, which is flashed via throttling in a second J-T valve 200 to produce a flashed second liquefied natural gas stream that is mixed with the flashed first liquefied natural gas stream 110 to produce a mixed stream 122. The mixed stream 122 is sent to a vapor-liquid separator (in this case an endflash drum) 120. Flash gas removed as overhead from the endflash drum 120 forms a flash gas stream 125 that is warmed in the flash gas heat exchanger section 126 thereby providing refrigeration and cooling duty to the flash gas heat exchanger section 126. The warmed flash gas stream 127 exiting the flash gas heat exchanger section 126 is compressed in flash gas compressor 128 to produce a compressed flash gas stream 129 and cooled against ambient air or cooling water in a flash gas aftercooler 190 to produce the compressed flash gas stream 191 that is recycled back into the first natural gas feed stream 194.

The bottoms liquid from the endflash drum 120 is removed as a LNG product stream 121, which in this case is letdown in pressure in an LNG letdown valve 123 to produce a reduced pressure LNG product stream 124 which is sent to the LNG storage tank 115. Any boil off gas (or further flash gas) produced in the LNG storage tank is removed from the tank as boil-off gas (BOG) stream 112, which may be used as fuel in the plant or flared, or mixed with the flash gas stream 125 and subsequently recycled to the feed.

Refrigeration to the MCHE 198 is provided by a refrigerant circulating in a refrigeration circuit comprising the heat exchanger sections 198A, 198B of the MCHE 198, a compressor train comprising compression system 136 and aftercooler 156, a first turbo-expander 164 and a second turbo-expander 172. A warm gaseous refrigerant stream 130 is withdrawn from the MCHE 198 and any liquid present in it during transient off design operation, may be removed in a knock-out drum 132. The overhead warm gaseous refrigerant stream 134 is then compressed in compression system 136 to produce a compressed refrigerant stream 155. In the refrigerant compression system 136, the overhead warm gaseous refrigerant stream 134 is compressed in a first compressor 137 to produce a first compressed refrigerant stream 138, cooled against ambient air or cooling water in a first intercooler 139 to produce a first cooled compressed refrigerant stream 140, which is further compressed in a second compressor 141 to produce a second compressed refrigerant stream 142. The second compressed refrigerant stream 142 is cooled against ambient air or cooling water in a second intercooler 143 to produce a second cooled compressed refrigerant stream 144, which is split into two portions, a first portion 145 and a second portion 146. The first portion of the second cooled compressed refrigerant stream 145 is compressed in a third compressor 147 to produce a third compressed stream 148, while the second portion of the second cooled compressed refrigerant stream 146 is compressed in a fourth compressor 149 to produce a fourth compressed stream 150. The third compressed stream 148 and the fourth compressed stream 150 are mixed to produce the compressed refrigerant stream 155.

The compressed refrigerant stream 155 is cooled against ambient air or cooling water in a refrigerant aftercooler 156 to produce a compressed and cooled gaseous stream of refrigerant 158. The cooled compressed gaseous refrigerant stream 158 is then split into two streams, namely a first stream of cooled gaseous refrigerant 162 and a second stream of cooled gaseous refrigerant 160. The second stream 160 passes through and is cooled in the warm side of the warm section 198A of the MCHE 198, via a separate passage in said warm side to the passage through which first the natural gas feed stream 104 is passed, to produce a further cooled second stream of cooled gaseous refrigerant 168, while the first stream 162 is expanded in the first turbo-expander 164 (also referred to herein as the warm expander) to produce a first stream of expanded cold refrigerant 166 that is passed through the cold side of the warm section 198A of the MCHE 198 where it is warmed to provide refrigeration and cooling duty for precooling the first natural gas feed stream 104 and cooling the second stream of cooled gaseous refrigerant 160.

The further cooled second stream of cooled refrigerant 168 is expanded in the second turbo-expander 172 (as referred to herein as the cold expander) to produce a second stream of expanded cold refrigerant 174 that is passed through the cold side of the cold section 198B of the MCHE 198, where it is warmed to provide refrigeration and cooling duty for liquefying the precooled first cooled natural gas feed stream 105, and is then passed through and further warmed in the cold side of the warm section 198A of the MCHE 198 where it mixes with first stream of expanded cold refrigerant 166. The first and second streams of expanded cold refrigerant 166 and 174 are at least predominantly gaseous with a vapor fraction greater than 0.8, and preferably greated than 0.85, at the exit of respectively the first and second turbo-expanders 164 and 172.

The third compressor 147 may be driven at least partially by power generated by the warm expander 164, while the fourth compressor 149 may be driven at least partially by power generated by the cold expander 172, or vice versa. Equally, the warm and/or cold expanders could drive any of the other compressors in the compressor train. Although depicted in FIG. 1 as being separate compressors, two or more of the compressors in the compressor system could instead be compression stages of a single compressor unit. Equally, where one or more of the compressors are driven by one or more of the the exapnders, the associated compressors and expanders may be located in one body and together called a compressor-expander body or compander.

A drawback of the prior art arrangements shown in FIG. 1 is that the refrigerant provides cooling duty to the warm and middle sections at roughly the same pressure. This is because the cold streams mix at the top of the warm section, resulting in similar outlet pressures from the warm and cold expanders. Any minor differences in these outlet pressures in the prior art configuration are due to the heat exchanger cold-side pressure drop across the cold and warm sections, which is typically less than about 45 psia (3 bara), preferably less than 25 psia (1.7 bara), and more preferably less than 10 psia (0.7 bara) for each section. This pressure drop varies based on the heat exchanger type. Therefore, the prior art configuration does not provide the option of adjusting the pressures of the cold streams based on refrigeration temperature desired.

Figure 2:
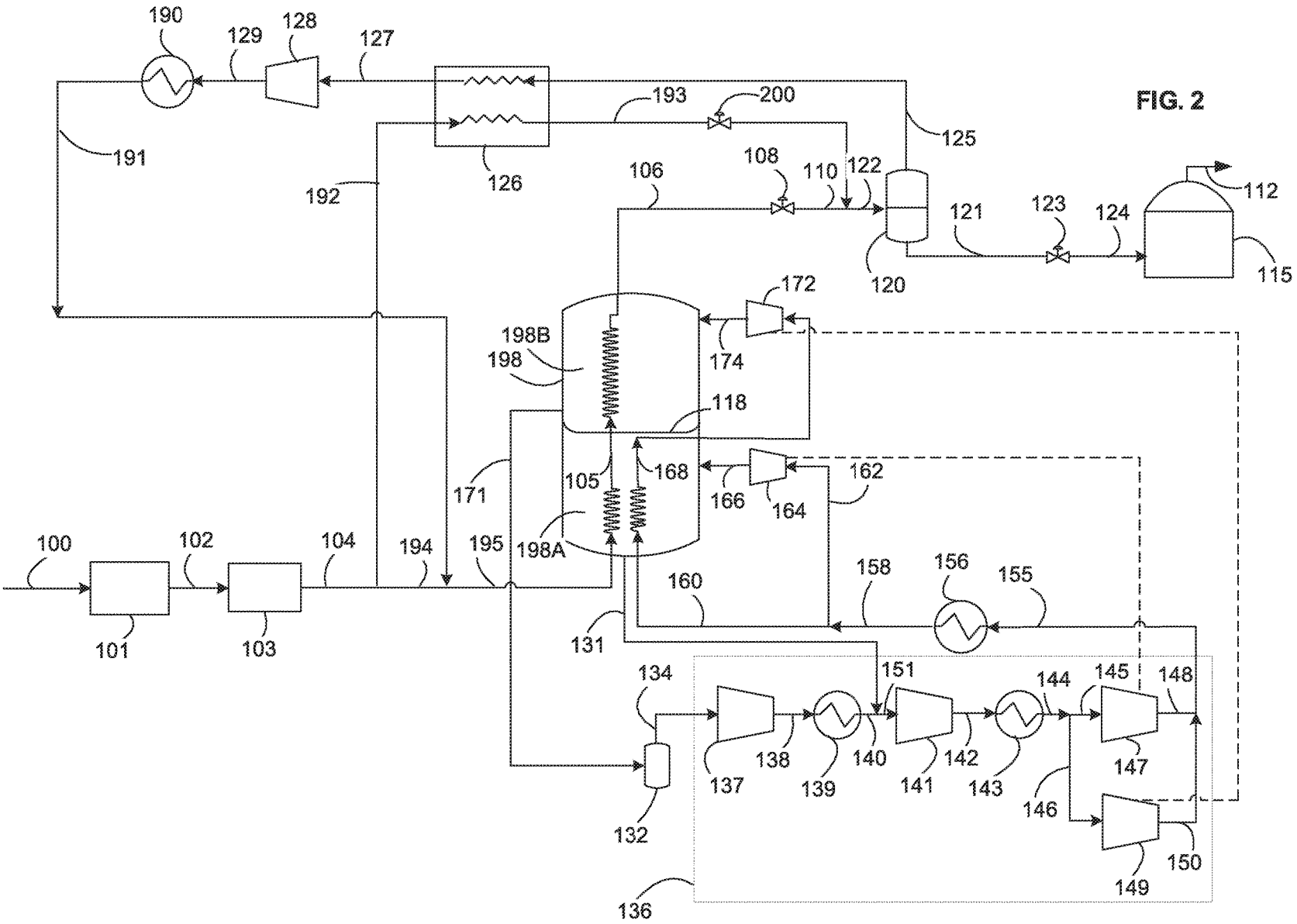
FIG. 2 is a schematic flow diagram depicting a natural gas liquefaction method and system in accordance with a first embodiment.

FIG. 2 shows a first embodiment, which offers an improvement over FIG. 1.

A raw natural gas feed stream 100 is optionally pretreated in a pretreatment system 101 to remove impurities such as mercury, water, acid gases, and heavy hydrocarbons and produce a pretreated natural gas feed stream 102, which may optionally be precooled in a precooling system 103 to produce a natural gas feed stream 104.

The natural gas feed stream 104 is split to form a first natural gas feed stream 194 and a second natural gas feed stream 192. A compressed flash gas stream 191 is recycled by being mixed with the first natural gas feed stream 194 prior to the resulting first natural gas stream 195 (containing also the recycled flash gas) being precooled and liquefied, as further described below. Alternatively, the compressed flash gas stream 191 may be recycled by being mixed with the natural gas feed stream 104 prior to said stream being split to form the first and second natural gas feed streams. The second natural gas feed stream 192 is preferably between about 5 mole % and 30 mole %, and more preferably between about 10 mole % and 20 mole % of natural gas feed stream 104 (ignoring the recycled flash gas stream). Consequently, the ratio of the molar flow rate of the second natural gas feed stream 192 to the first natural gas feed stream 194 (ignoring the recycled flash gas stream) is preferably between about 0.05 and 0.45, and more preferably between about 0.1 and 0.25.

The first natural gas stream 195 is cooled in a first heat exchanger section 198A to produce a precooled first natural gas stream 105, and the precooled first natural gas stream 105 from the first heat exchanger section 198A is then further cooled and liquefied in a second heat exchanger section 198B to produce a first liquefied natural gas stream 106. The first liquefied natural gas stream 106 withdrawn from the second heat exchanger section 198B is then flashed, form example via throttling in a first J-T valve 108, to produce a flashed first liquefied natural gas stream 110.

The first and second heat exchanger sections 198A, 198B may be heat exchanger sections of any type, such as a coil wound sections, plate and fin sections, shell and tube sections, or any other suitable type of heat exchanger section known in the art. However in a preferred embodiment the first and second heat exchanger sections 198A, 198B are each coil wound heat exchanger sections (such as is depicted in FIG. 2, where the first heat exchanger section comprises a first tube bundle and where the second heat exchanger section comprises a second tube bundle). Additional heat exchanger sections may also be present. The heat exchanger sections may all be located within one casing, such as is depicted in FIG. 2 where the first and second heat exchanger sections 198A, 198B are contained within a single shell casing of a coil wound MCHE 198, the first heat exchanger section 198A representing the warm section (warm tube bundle) of the MCHE 198, and the second heat exchanger section 198B representing the cold section (cold tube bundle) of the MCHE 198. Altneratively, the first and second heat exchanger sections 198A, 198B may be contained within separate casing.

The second natural gas feed stream 192 is cooled and liquefied in a flash gas heat exchanger section 126 to produce a second liquefied natural gas stream 193, which is flashed, for example via throttling in a second J-T valve 200, to produce a flashed second liquefied natural gas stream that is mixed with the flashed first liquefied natural gas stream 110 to produce a mixed stream 122. The mixed stream 122 is sent to a vapor-liquid separator (in this case an endflash drum) 120. Flash gas removed as overhead from the endflash drum 120 forms a flash gas stream 125 that is warmed in the flash gas heat exchanger section 126 thereby providing refrigeration and cooling duty to the flash gas heat exchanger section 126. The warmed flash gas stream 127 exiting the flash gas heat exchanger section 126 is compressed in a flash gas compressor 128 to produce a compressed flash gas stream 129 and cooled against ambient air or cooling water in a flash gas aftercooler 190 to produce the compressed flash gas stream that is recycled back into the first natural gas feed stream 194. The flash gas heat exchanger section 126 may be a heat exchanger section of any suitable heat exchanger type, such as coil wound section, plate and fin section (as shown in FIG. 2) or shell and tube section. More than one flash gas heat exchanger section may also be used, which sections may be contained in a single or separate casings. The second LNG stream 193 is typically produced (i.e. exits the flash gas heat exchanger section 126) at a temperature of from about −140 to −150 degrees Celsius.

The bottoms stream from the endflash drum 120 is removed as an LNG product stream 121, which may (as depicted) be letdown in pressure in a first LNG letdown valve 123 to produce a reduced pressure LNG product stream 124, which is sent to the LNG storage tank 115. Any boil off gas (or further flash gas) produced or present in the LNG storage tank is removed from the tank as boil off gas (BOG) stream 112, which may be used as fuel in the plant or flared, or mixed with the flash gas stream 125 and subsequently recycled to the feed.

In an alternative embodiment, instead of cooling the second natural gas feed stream in the flash gas heat exchanger section 126, another type of stream may be passed through and cooled in the warm side of the flash gas heat exchanger 126, such as for example a portion of the second stream of cooled gaseous refrigerant 160. In yet another embodiment, the warm side of the flash gas heat exchanger section 126 may define a pluarilty of separate passages throught he heat exchanger section allowing two or more different streams, such as for example the second natural gas feed stream and a refrigerant stream, to separately pass through and be cooled in the warm side of the flash gas heat exchanger section 126.

As noted above, in the embodiment depicted in FIG. 2 the MCHE 198 is a coil wound heat exchanger unit comprising the first heat exchanger section (the warm section/tube bundle) 198A and the second heat exchanger section (the cold section/tube bendle) 198B contained in a single shell casing. The MCHE 198 in FIG. 2 further comprises a head 118 that separates the cold side of the warm section 198A from the cold section of the cold section 198B, thereby preventing refrigerant flowing through the cold side of the cold section 198B from flowing into the cold side of the warm section 198A. The head 118 thus contains shell-side pressure and allows the cold side of the warm section to be at a different shell-side pressure to the cold side of the cold section. However, as also noted above, in a variant of the embodiment depicted in FIG. 2 two separate heat exchangers units may be used, wherein the first heat exchanger section 198A is encased in its own shell casing, and the second heat exchanger unit 198B is encased in another separate shell casing, thereby eliminating the need for the head 118.

Refrigeration is provided to the first and second heat exchanger sections 198A and 198B by a refrigerant circulating in a closed-loop refrigeration circuit, which closed-loop circuit comprises: said heat exchanger sections 198A, 198B; a compressor train comprising a compression system 136 (comprsing compressors/compression stages 137, 141, 147, 149 and intercoolers 139, 143) and an aftercooler 156; a first turbo-expander 164; and a second turbo-expander 172.

A first stream of warmed gaseous refrigerant 131 is withdrawn from the warm end of the cold side of the first heat exchanger section 198A. The first stream of warmed gaseous refrigerant 131 may sent to a knock out drum (not shown) to remove any liquids that may be present in the stream during transient off design operation. A second stream of warmed gaseous refrigerant 171 is withdrawn from the warm end of the cold side of the second heat exchanger section 198B, the second stream of warmed gaseous refrigerant 171 being at a lower pressure than the first stream of warmed gaseous refrigerant 131. In this embodiment the second stream of warmed gaseous refrigerant 171 is also at a lower lower temperature than the first stream of warmed gaseous refrigerant, the temperature of the second stream of warmed gaseous refrigerant being typically about −40 degrees Celsius to −70 degrees Celsius. The second stream of warmed gaseous refrigerant 171 may similarly be sent to another knock-out drum 132 to remove any liquids that may be present during transient off design operation, the second stream of warmed gaseous refrigerant leaving the knock-out drum 132 as overhead stream 134. The first stream of warmed gaseous refrigerant 131 and the second stream of warmed gaseous refrigerant 134 are then introduced into different locations of the compression system 136, the second stream of warmed gaseous refrigerant being introduced into the compression system at a lower pressure location than the first stream of warmed gaseous refrigerant.

In the refrigerant compression system 136, the second stream of warmed gaseous refrigerant 134 is compressed in a first compressor/compression stage 137 to produce a first compressed refrigerant stream 138, which is cooled against ambient air or cooling water in a first intercooler 139 to produce a first cooled compressed refrigerant stream 140. The first stream of warmed gaseous refrigerant 131 is mixed with the first cooled compressed refrigerant stream 140 to produce a mixed medium pressure refrigerant stream 151, which is further compressed in a second compressor 141 to produce a second compressed refrigerant stream 142. The second compressed refrigerant stream 142 is cooled against ambient air or cooling water in a second intercooler 143 to produce a second cooled compressed refrigerant stream 144, which is split into two portions, a first portion 145 and a second portion 146. The first portion of the second cooled compressed refrigerant stream 145 is compressed in a third compressor 147 to produce a third compressed stream 148, while the second portion of the second cooled compressed refrigerant stream 146 is compressed in a fourth compressor 149 to produce a fourth compressed stream 150. The third compressed stream 148 and the fourth compressed stream 150 are mixed to produce a compressed refrigerant stream 155.

The compressed refrigerant stream 155 is cooled against ambient air or cooling water in the refrigerant aftercooler 156 to produce a compressed and cooled gaseous stream of refrigerant 158. The cooled compressed gaseous refrigerant stream 158 is then split into two streams, namely a first stream of cooled gaseous refrigerant 162 and a second stream of cooled gaseous refrigerant 160. The second stream of cooled gaseous refrigerant 160 passes through and is cooled in the warmed side of in the first heat exchanger section 198A, via a separate passage in said warm side to the the passage through which the natural gas feed stream 195 is passed, to produce a further cooled second stream of cooled gaseous refrigerant 168. The first stream of cooled gaseous refrigerant 162 is expanded down to a first pressure in the first turbo-expander 164 (as referred to herein as the warm expander) to produce a first stream of expanded cold refrigerant 166 at a first temperature and said first pressure and that is at least predominantly gaseous, having a vapor fraction greater than greater than 0.8, and preferably greated than 0.85, as it exits the first turbo-expander. The first stream of expanded cold refrigerant 166 is passed through the cold side of the first heat exchanger section 198A where it is warmed to provide refrigeration and cooling duty for precooling the first natural gas feed stream 195 and cooling the the second stream of cooled gaseous refrigerant 160 to produce the precooled first natural gas stream 105 and the further cooled second stream of cooled gaseous refrigerant 168, respectively, the first stream of expanded cold refrigerant 166 being warmed to form the first stream of warmed gaseous refrigerant 131. The precooled first natural gas stream 105 and the further cooled second stream of cooled gaseous refrigerant 168 are produced at a temperature at a temperature between about −25 degrees Celsius and −70 degrees Celsius and preferably between about −35 degrees Celsius and −55 degrees Celsius.

The second stream cooled gaseous refrigerant stream 168 is expanded down to a second pressure in the second turbo-expander (aslso referred to herein as the cold expander) 172 to produce a second stream of expanded cold refrigerant 174 at a second temperature and said second pressure and that is at least predominantly gaseous, having a vapor fraction greater than greater than 0.8, and preferably greated than 0.85, as it exits the second turbo-expander. The second temperature and second pressure are each lower than, respectively, the first temperature and the first pressure. The second stream of expanded cold refrigerant 174 is passed through the cold side of the second heat exchanger section 198B where it is warmed to provide refrigeration and cooling duty for liquefying the precooled first natural gas feed stream 105 to produce the first liquefied natural gas stream 106, the second stream of expanded cold refrigerant 174 being warmed to form the second stream of warmed gaseous refrigerant 171. The first liquefied natural gas stream 106 is typically produced at a temperature of about −100 degrees Celsius to about −145 degrees Celsius, and more preferably at a temperature of about −110 degrees Celsius to about −145 degrees Celsius.

The second stream of cooled gaseous refrigerant 160 is between about 35 mole % and 80 mole % of the cooled compressed gaseous refrigerant stream 158 and preferably between about 50 mole % and 70 mole % of the cooled compressed gaseous refrigerant stream 158.

As noted above, the second pressure (pressure of the second stream of expanded cold refrigerant 174) is lower than the first pressure (pressure of the first stream of expanded cold refrigerant 166). In a preferred embodiment, the pressure ratio of the first pressure to the second pressure is from 1.5:1 to 2.5:1. In a preferred embodiment, the pressure of the first stream of expanded cold refrigerant 166 is between about 10 bara and 40 bara, while the pressure of the second stream of expanded cold refrigerant 174 is between about 5 bara and 25 bara. Correspondingly, the second stream of warmed gaseous refrigerant 173 has a pressure between about 5 bara and 25 bara, while the first stream of warmed gaseous refrigerant 131 has a pressure between about 10 bara and 40 bara.

The third compressor 147 may be driven at least partially by power generated by the warm expander 164, while the fourth compressor 149 may be driven at least partially by power generated by the cold expander 172, or vice versa. Alternatively, any of the other compressors in the compression system could be driven at least partially by the warm expander and/or cold expander. The compressor and expander units may be located in one casing, called a compressor-expander assembly or compander. Any additional power requires may be provided using an external driver, such as an electric motor or gas turbine. Using a compander lowers the plot space of the rotating equipment, and improves the overall efficiency.

The refrigerant compression system 136 shown in FIG. 2 is an exemplary arrangement, and several variations of the compression system and compressor train are possible. For instance, although depicted in FIG. 2 as being separate compressors, two or more of the compressors in the compression system could instead be compression stages of a single compressor unit. Equally, each compressor shown may comprise multiple compression stages in one or more casings. Multiple intercoolers and aftercoolers maybe present. Each compression stage may comprise one or more impellers and associated diffusers. Additional compressors/compression stages could be included, in series or parallel with any of the compressors shown, and/or one or more of the depicted compressors could be omitted. The first compressor 137 the second compressor 141, and any of the other compressors maybe driven by any kind of driver, such as an electric motor, industrial gas turbine, aero derivative gas turbine, steam turbine, etc. The compressors may be of any type, such as centrifugal, axial, positive displacement, etc.

In a preferred embodiment, the first stream of warmed gaseous refrigerant 131 may be introduced as a side-stream in a multi-stage compressor, such that the first compressor 137 and the second compressor 141 are multiple stages of a single compressor.

In another embodiment (not shown), the first stream of warmed gaseous refrigerant 131 and the second stream of warmed gaseous refrigerant 171 may be compressed in parallel in separate compressors and the compressed streams may be combined to produce the second compressed refrigerant stream 142.

The refrigerant circulating in the refrigeration circuit is a refrigerant that comprises methane. It may also comprise nitrogen or any other suitable refrigerant components known and used in the art, to the extent that these do not affect the first and second expanded cold refrigerant streams being at least predominatly gaseous at the exit of, respectively, the first and second turbo-expanders. A preferred composition of the cooled compressed refrigerant stream 158 is a stream that is at least about 85% mole %, more preferably at least about 90 mole %, more preferably at least about 95 mole % and most preferably about 100 mole % methane, such as may be obtained from the natural feed gas or flash gas, such that no external refrigerant is required. Another preferred composition of the cooled compressed refrigerant stream 158 is a nitrogen-methane mixture comprising about 25 mole % to 65 mole %, more preferably about 30 mole % to 60 mole % nitrogen, and comprising about 30 mole % to 80 mole %, more preferably about 40 mole % to 70 mole % methane.

A key benefit of the embodiment shown in FIG. 2 over the prior art is that the pressures of the first stream of expanded cold refrigerant 166 and the second stream of expanded cold refrigerant 174 are significantly different. This enables the provision of cooling at different pressures for the liquefying and precooling portions of the process. Lower refrigerant pressure is preferable for the liquefying portion and higher refrigerant pressure is preferable for the precooling portion. By allowing the warm and cold expander pressures to be significantly different, the process results in higher overall efficiency. As a result, the warm expander 164 is used to primarily provide precooling duty, while the cold expander 172 is used to primarily provide liquefaction duty. Furthermore by using coil wound heat exchanger sections for the first heat exchanger section (precooling section) 198A and second heat exchanger section (liquefying section) 198B that have cold sides (shell sides) that are isolated from each other, coil wound heat exchanger sections can still be used for precooling and liquefying the natural gas despite using different pressure refrigerants to provide the cooling duty for precooling and liquefaction. This then also allows the further benefits of using coil wound heat exchanger sections (namely compactness and high efficiency) to be obtained. As the second stream of warmed gaseous refrigerant (the warmed refrigerant exiting the cold side of the liquefying section) 171 is at a lower pressure than the first stream of warmed gaseous refrigerant (the warmed refrigerant exiting the cold side of the precooling section) 131, the second stream of warmed gaseous refrigerant 171 is sent to a lower pressure location of the compressor train, such as for example to the lowest pressure inlet of the refrigerant compression system 136, while the first stream of warmed gaseous refrigerant 131 is sent to a higher pressure location of the compressor train, for example as a side-stream into the refrigerant compression system 136. A key advantage of such an arrangement is that it results in a compact system with higher process efficiency than the prior art processes. Furthermore by making the precooling and liquefaction process more efficient, it may as a result also be possible to use a smaller flash gas heat exchanger section 126 (due to less flash gas being generated when the liquefied natural gas stream from the liquefication heat exchanger section 198B is flashed to provide the lower temperature LNG product), thereby also reducing overall capital cost.

In this embodiment, the second stream of warmed gaseous refrigerant 171 is "cold compressed" or compressed at a colder temperature. Despite this, the arrangement still results (as noted above) in higher process efficiency as compared to the prior art for the same equipment count.

Figure 3:
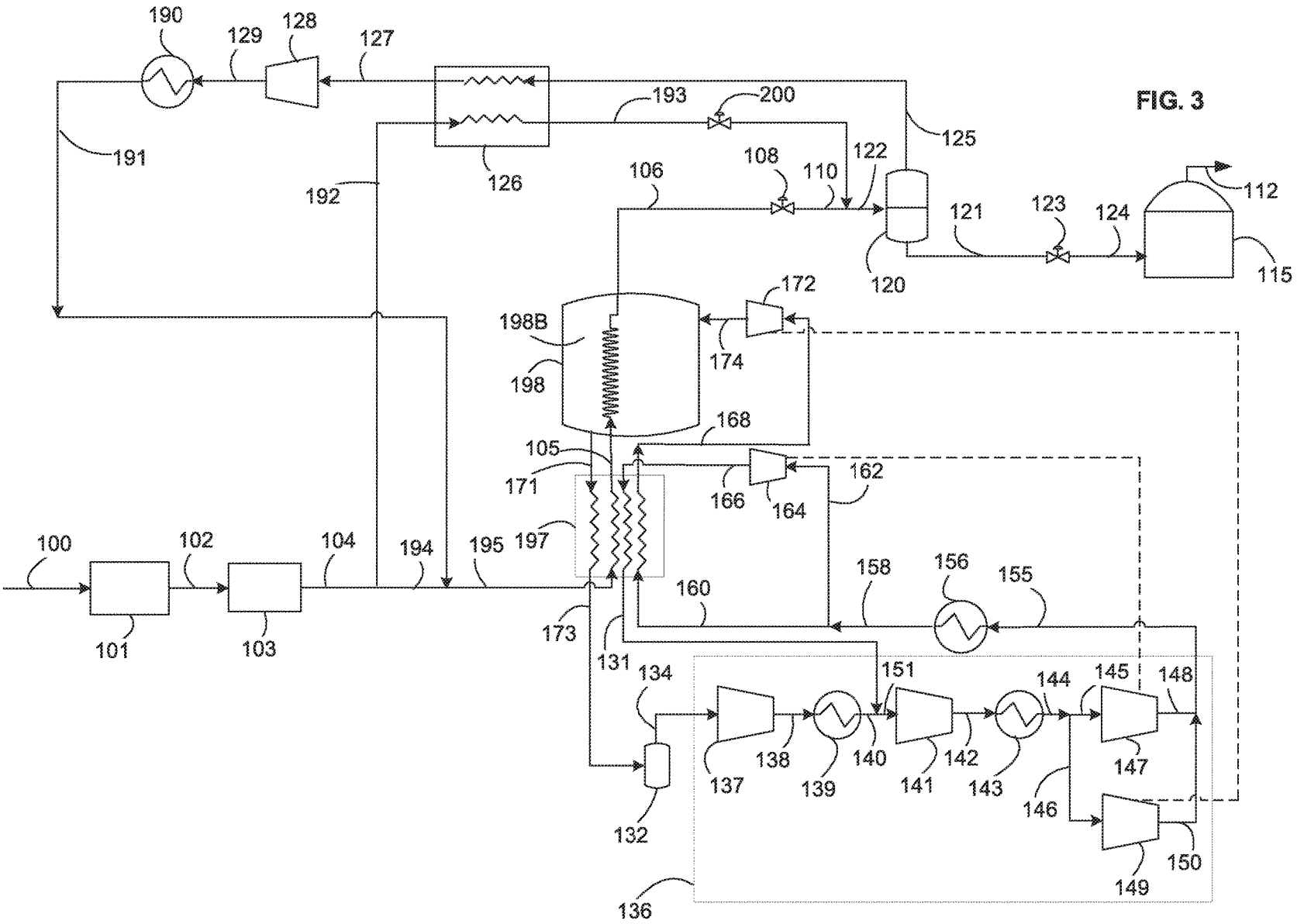
FIG. 3 is a schematic flow diagram depicting a natural gas liquefaction method and system in accordance with an second embodiment.

FIG. 3 shows a variation of FIG. 2 and a second embodiment. The MCHE 198 in this embodiment comprises only the second heat exchanger section 198B (equivalent to the cold section of the MCHE in FIGS. 1 and 2) in which the precooled first natural gas feed stream is liquefied. In lieu of the MCHE 198 containing also a second, warm section 198A, in this embodiment the first heat exchanger section 197 in which the first natural gas feed stream is precooled is located in a separate unit, and is a plate and fin heat exchanger section (as shown) or any other suitable type of heat exchanger section known in the art that has a cold side that defines a plurality of separate passages through the heat exchanger section, allowing more than one stream of refrigerant to pass separately through the cold side of of said section without being mixed. The inlets and outlets of the the first heat exchanger section 197 may be located at the warm end, cold end, and/or at any intermediate location of the section.

As in the previous embodiment, The first natural gas stream 195 (containing also the recycled flash gas) passes through and is cooled in the warm side of the first heat exchanger section 197 to produce the precooled first natural gas stream 105, which then passes through and is further cooled and liquefied in the warm side of the second heat exchanger section 198B to produce the first liquefied natural gas stream 106.

Also as in the previous embodiment, the second stream of expanded cold refrigerant 174 is passed through the cold side of the second heat exchanger section 198B where it is warmed to provide refrigeration and cooling duty for liquefying the precooled first cooled natural gas feed stream 105 to produce the first liquefied natural gas stream 106. However, in this embodiment the resulting warmed second stream of expanded cold refrigerant 171 exiting the cold side of the second heat exchanger section 198B does not immediately form the second stream of warmed gaseous refrigerant that is sent to and compressed in the compression system 136.

Rather, in this embodiment the resulting warmed second stream of expanded cold refrigerant 171 that is withdrawn from the warm end of the cold side of the second heat exchanger section 198B next passes through the cold side of first heat exchanger section 197 where it is further warmed to provide refrigeration and cooling duty for precooling the first natural gas feed stream 104 and cooling the the second stream of cooled gaseous refrigerant 160. The resulting further warmed second stream of expanded cold refrigerant withdrawn the cold side of the first heat exchanger section 197 then forms the second stream of warmed gaseous refrigerant 173. As previously described, the second stream of warmed gaseous refrigerant 173 may then be sent to a knock-out drum 132 to knock out any liquids that may be present, prior to the second stream of warmed gaseous refrigerant (leaving said knock out drum as an overhead stream 134) being sent to and compressed in a refrigerant compression system 136.

The first stream of expanded cold refrigerant 166 also passes through the cold side of first heat exchanger section 197 where it is also warmed to provide refrigeration and cooling duty for precooling the first natural gas feed stream 104 and cooling the second stream of cooled gaseous refrigerant 160. However, the first stream of expanded cold refrigerant 166 passes through a separate passage in the cold side of the first heat exchanger section 197 from the passage in the cold side through which the second stream of expanded cold refrigerant 171 passes, such that the two streams are not mixed in the cold side of said heat exchanger section. The resulting warmed first stream of expanded cold refrigerant exiting the cold side of the first heat exchanger section 197 as before forms the first stream of warmed gaseous refrigerant 131, which is then sent to and compressed in the refrigerant compression system 136 as previously described.

A key benefit of the embodiment shown in FIG. 3 over the prior art is again that the pressures of the first stream of expanded cold refrigerant 166 and the second stream of expanded cold refrigerant 174 are significantly different, enabling the provision cooling at different pressures for the liquefying and precooling portions of the process, and thereby resulting in higher overall efficiency. As in the embodiment shown in FIG. 2, a coil wound heat exchanger section can still be used for the second heat exchanger section (liquefying section) 198B thereby providing further benefits in terms of compactness and efficiency. However, as compared to the embodiment shown in FIG. 2, in this embodiment a first heat exchanger section (precooling section) 197 is used that has a cold side that defines a plurality separate passages through the section, thereby allowing the warmed second stream of expanded cold refrigerant 171 exiting the cold side of the second heat exchanger section 198B to be further warmed in the cold side of the first heat exchanger section 197. This means that, as compared to the embodiment shown in FIG. 2, in this embodiment further refrigeration can be recovered from the second stream of expanded cold refrigerant 171 with the resulting second stream of warmed gaseous refrigerant 173 not needing to be cold compressed, which results in the efficiency of the process being yet further improved.

Figure 4:
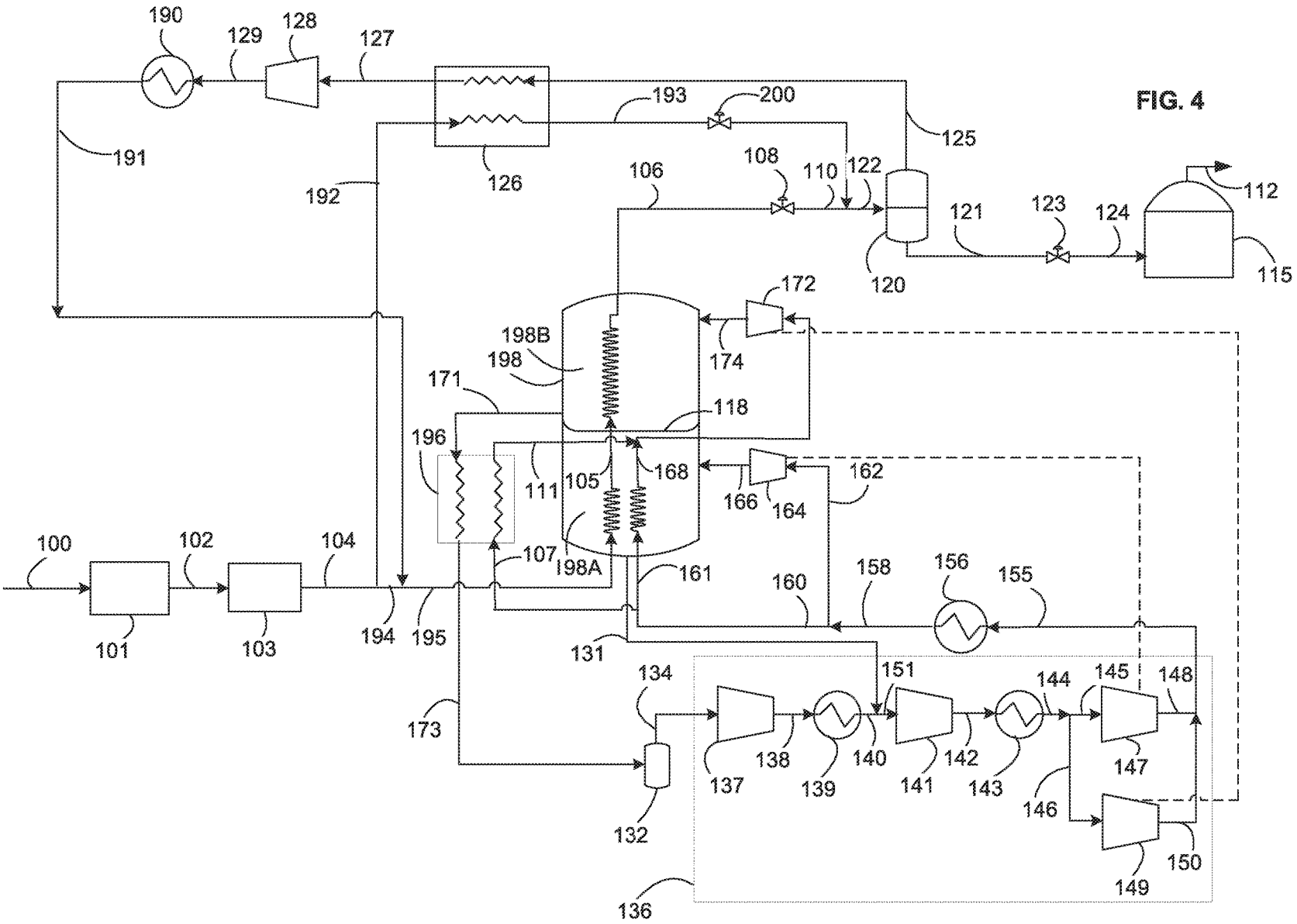
FIG. 4 is a schematic flow diagram depicting a natural gas liquefaction method and system in accordance with a third embodiment.

FIG. 4 shows a third embodiment and another variation of FIG. 2. As compared to the arrangement shown in FIG. 2, in this embodiment the resulting warmed second stream of expanded cold refrigerant 171 exiting the cold side of the second heat exchanger section 198B does not immediately form the second stream of warmed gaseous refrigerant that is sent to and compressed in the compression system 136, and hence is not cold compressed. Instead, in this the embodiment the refrigeration ciruit further comprises a third heat exchanger section 196, and further refrigeration is extracted from the warmed second stream of expanded cold refrigerant 171 by passing said stream through and further warming said stream in the cold side of the third heat exchanger section 196 to produce the second stream of warmed gaseous refrigerant 173 that is then sent (optionally via a knock out drum) to the compression system 136 as previously described. The third heat exchanger section 196 may be a heat exchanger section of any suitable heat exchanger type, for example such as a coil wound section, plate and fin section (as shown in FIG. 2) or shell and tube section.

In the arrangement shown in FIG. 4 the further refrigeration extracted from the warmed second stream of expanded cold refrigerant 171 in the third heat exchanger section 196 is used to provide cooling duty for precooling a portion 107 of the second stream of cooled gaseous refrigerant 160. More specifically, the second stream of cooled gaseous refrigerant 160 is split into two portions, namely a first portion 161 and a second portion 107. The first portion 161 is passed through and cooled in the warm side of the first heat exchanger section 198A to produce a first portion of the further cooled second stream of cooled gaseous refrigerant 168, refrigeration and cooling duty in the first heat exchanger section 198A being provided by the first stream of expanded cold refrigerant 166 which is warmed in the cold side of the first heat exchanger section 198A to produce the first stream of warmed gaseous refrigerant 131 as previously described.

The section portion 107 of the second stream of cooled gaseous refrigerant passes through and is cooled in the warm side of the third heat exchanger section 196 to produce a second portion 111 of the further cooled second stream of cooled gaseous refrigerant, which is then combined with the first portion 168 to provide the further cooled second stream of cooled gaseous refrigerant that is then expanded in the second turbo-expander 172 to provide the second stream of exapanded cold refrigerant 174, as previously described. In a preferred embodiment, the second portion 107 of the second stream of cooled gaseous refrigerant is between about 50 mole % and 95 mole % of the second stream of cooled gaseous refrigerant 160.

In an alternative embodiment, instead of being used to cool a portion 107 of the second stream of cooled gaseous refrigerant the third heat exchanger section 196 may instead be used to cool a natural gas stream. For example, the first natural gas feed stream 195 may be divided into two streams, with a first stream being passed through and cooled in the warm side of the first heat exchanger section 198A as previously descrided, and with a second stream being passed through and cooled in the warm side of the third heat exchanger section 196, the precooled natural gas streams exiting the first and third heat exchanger sections being recombined and mixed to form the precooled first natural gas stream 105 that is then further cooled and liquefied in the second heat exchanger section 198B as previously described. In yet another variant, the third heat exchanger section could have a warm side that defines more than one separate passage through the section, and could be used to cool both a portion 107 of the second stream of cooled gaseous refrigerant and a natural gas stream.

The embodiment shown in FIG. 4 has all the benefits of the embodiment shown in FIG. 3, which includes higher process efficiency than the prior art. In addition, since only one stream of refrigerant (the first stream of expanded cold refrigerant 166) passes through the cold side of the first heat exchanger section 198A, a coil wound heat exchanger section may be used for this section. However, this arrangement does require the use of an additional piece of equipment in the form of the third heat exchanger section 196.

Figure 5:
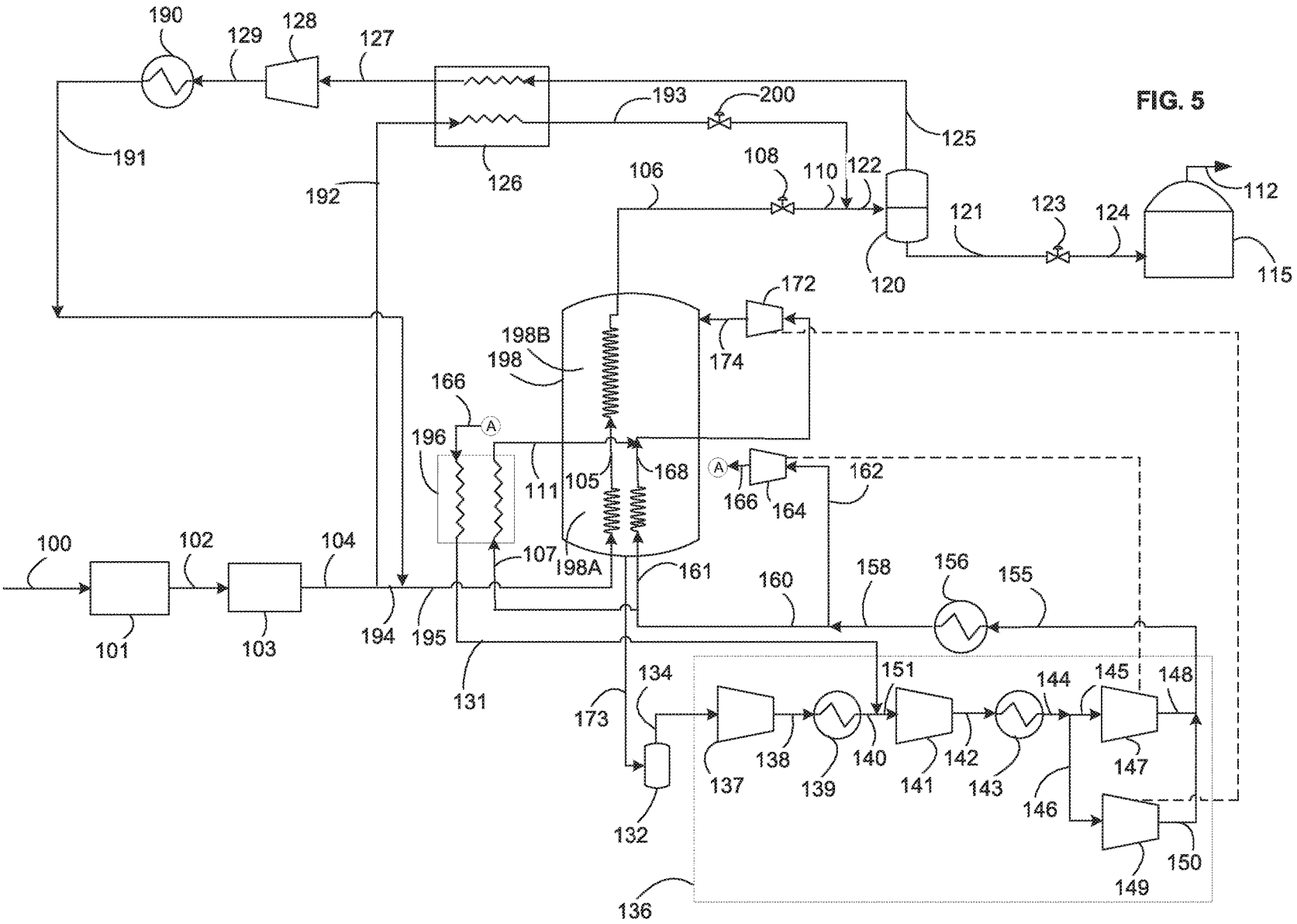
FIG. 5 is a schematic flow diagram depicting a natural gas liquefaction method and system in accordance with a fourth embodiment.

FIG. 5 shows a fourth embodiment and a variation of FIG. 4. In this embodiment first heat exchanger section 198A and second heat exchanger section 198B are again preferably a coil-wound heat exchanger sections that are in this embodiment contained in the same shared shell casing of a MCHE 198, the first heat exchanger section 198A for example representing the warm section (tube bundle) of the MCHE and second heat exchanger section 198B for example representing the cold section (tube bundle) of the MCHE. However, in this embodiment the MCHE 198 no longer contains a head 118 that separates the cold side (shell side) of the first heat exchanger section 198A from the cold side (shell side) of the second heat exchanger section 198B, and refrigeration for the first heat exchanger section 198A is no longer provided by the first stream of expanded cold refrigerant 166. Instead, the warmed second stream of expanded cold refrigerant exiting the warm end of the cold side (shell side) of the second heat exchanger section 198B flows on into, passes through and is further warmed in the cold side (shell side) of the first heat exchanger section 198A to provide cooling duty in the first heat exchanger section 198A, the warmed second stream of expanded cold refrigerant being further warmed in said section 198A to produce the second stream of warmed gaseous refrigerant 173 that is then sent (optionally via a knock out drum) to the compression system 136 as previously described.

Similarly, in the embodiment shown in FIG. 5, refrigeration for the third heat exchanger section 196 is no longer provided by the warmed second stream of expanded cold refrigerant exiting the warm end of the cold side (shell side) of the second heat exchanger section 198B. Instead, the first stream of expanded cold refrigerant 166 passes through and is warmed in the cold side of the third heat exchanger section 196 to provide cooling duty in the third heat exchanger section 196, the first stream of expanded cold refrigerant 166 being warmed in said section 196 to produce the first stream of warmed gaseous refrigerant 131, which is then sent to and compressed in the refrigerant compression system 136 as previously described.

In a preferred embodiment according to FIG. 5, the second portion 107 of the second stream of cooled gaseous refrigerant is between about 20 mole % and 60 mole % of the second stream of cooled gaseous refrigerant 160

Alternatively, and as also described above in relation to FIG. 4, in a variant of the embodiment shown in FIG. 5, the third heat exchanger section 196 may be used to cool a natural gas stream instead of being used to cool a portion 107 of the second stream of cooled gaseous refrigerant. In yet another variant (again as also described above in relation to FIG. 4), the third heat exchanger section 196 could have a warm side that defines more than one separate passage through the section, and could be used to cool both a portion 107 of the second stream of cooled gaseous refrigerant and a natural gas stream.

The embodiment shown in FIG. 5 has all the benefits of the embodiment shown in FIG. 3, which includes higher process efficiency than the prior art. In addition, since only one stream of refrigerant (the warmed second stream of expanded cold refrigerant) passes through the cold side of first heat exchanger section 198A, a coil wound heat exchanger may be used for this section. However, this arrangement does require the use of an additional piece of equipment in the form of the third heat exchanger section 196. As compared to the embodiment shown in FIG. 4, the embodiment of FIG. 5 is simpler since the head 118 is not required and no stream of refrigerant needs to be extracted from the shell side of the MCHE 198 at the warm end of the second heat exchanger section 198B, resulting in a simpler heat exchanger design.

Although FIGS. 2-5 show the use of two levels of expansion of the circulating refrigerant (via the first and second turbo-exapnders), and one flash stage (J-T valve 108 and endflash drum 120) for flashing the first liquefied natural gas stream 106, further levels of expansion could be employed by adding additional turbo-expanders, and/or additional flash stages may be employed by further letting down the LNG stream 124 and generating one or more additional flash gas streams at further reduced pressure levels (with the resulting additional flash gas streams being warmed in the existing flash gas heat exchanger section and/or one or more additional flash gas heat exchanger sections). Additional flash stages enhance the process efficiency at increased capital cost and complexity.

Although FIGS. 2-5 show the use of a closed loop refrigeration system, an open loop system may also be used, wherein the refrigerant is obtained from the feed natural gas or flash gas.

In the above described embodiments presented herein, the need for external refrigerants can be minimised, as all the cooling duty for liquefying and sub-cooling the natural gas is provided by a refrigerant that comprises methane, which is available on-site in the form of the natural gas feed stream. In circumstances where it is desired to have also some nitrogen present in the refrigerant in order to further enhance efficiency, such nitrogen may already be present in and thus available on-site from the natural gas feed stream, and/or may be generated on-site from air.

To further enhance efficiency, the refrigeration cycles described above also employ multiple cold streams of the refrigerant at different pressures, wherein a first cold gaseous (or predominatly gaseous) refrigerant stream produced by a first turbo-expander is used to provide the refrigeration for precooling the natural gas, and wherein a second cold gaseous (or predominantly gaseous) refrigerant stream produced by a second turbo-expander is used to provide the refrigeration for liquefying the natural gas. The resulting liquefied natural gas is then flashed in an endflash system, comprising at least one pressure reducing device and at least one vapor-liquid separator (that is preferably in addition to any final LNG storage tank used to temporarily store the LNG product on site), in order to produce the LNG product at the required temperature, and a flash gas that is recycled back into the natural gas feed. This arrangement also minimizes or eliminates two-phase flow of refrigerant and avoids the need for separation of two-phase refrigerant.

In all the embodiments presented herein, inlet and outlet streams from heat exchanger sections may be side-streams withdrawn part-way through the cooling or heating process. For instance, in FIG. 3 the warmed second stream of expanded cold refrigerant stream 171 and/or the first stream of expanded cold refrigerant 166 may be side-streams in the first heat exchanger section 197. Further, in all the embodiments presented herein, any number of gas phase expansion stages may be employed.

Any and all components of the liquefaction systems described herein may be manafuactured by conventional techniques or via additive manufacturing.

Example 1

In this example, the method of liquefying a natural gas feed stream described and depicted in FIG. 3 was simulated. The results are shown in Table 1 and reference numerals of FIG. 3 are used.

TABLE 1

| Ref. # | Temp, F. | Temp, C. | Pressure, psia | Pressure, bara | Flow, lbmol/hr | Flow, kgmol/hr | Vapor fraction |
|---|---|---|---|---|---|---|---|
| 104 | 108 | 42 | 814 | 56 | 16,000 | 7,257 | 1 |
| 105 | −29 | −34 | 809 | 56 | 20,893 | 9,477 | 1 |
| 106 | −175 | −115 | 759 | 52 | 20,893 | 9,477 | 0 |
| 125 | −242 | −152 | 41 | 3 | 7,474 | 3,390 | 1 |
| 191 | 102 | 39 | 814 | 56 | 7,474 | 3,390 | 1 |
| 192 | 108 | 42 | 814 | 56 | 2,581 | 1,171 | 1 |
| 193 | −237 | −149 | 814 | 56 | 2,581 | 1,171 | 0 |
| 131 | 96 | 35 | 410 | 28 | 37,697 | 17,099 | 1 |
| 158 | 102 | 39 | 1250 | 86 | 88,413 | 40,103 | 1 |
| 160 | 102 | 39 | 1250 | 86 | 50,716 | 23,004 | 1 |
| 166 | −23 | −31 | 418 | 29 | 37,697 | 17,099 | 1 |
| 168 | −29 | −34 | 1243 | 86 | 50,716 | 23,004 | 1 |
| 173 | 96 | 35 | 183 | 13 | 50,716 | 23,004 | 1 |
| 174 | −179 | −117 | 195 | 13 | 50,716 | 23,004 | 0.92 |

In this example, the compressed and cooled gaseous stream of refrigerant 158 is methane. The pressure of the first stream of expanded cold refrigerant 166 is higher than that of the second stream of expanded cold refrigerant 174. In comparison, for the prior art arrangement shown in FIG. 1, the first stream of expanded cold refrigerant 166 and the second stream of expanded cold refrigerant 174 are at similar pressure of about 19 bara (279 psia). This pressure variance in the embodiment of FIG. 3 increases the process efficiency of the embodiment of FIG. 3 by about 5% as compared to the efficiency of FIG. 1 (prior art), both cases using pure methane as refrigerant.

This example is also applicable to the embodiments of FIG. 4 and FIG. 5. Referring to the embodiment of FIG. 4, the second portion 107 of the second stream of cooled gaseous refrigerant is about 85% of the second stream of cooled gaseous refrigerant 160. Referring to the embodiment of FIG. 5, the second portion 107 of the second stream of cooled gaseous refrigerant is about 50% of the second stream of cooled gaseous refrigerant 160.

It will be appreciated that the invention is not restricted to the details described above with reference to the preferred embodiments but that numerous modifications and variations can be made without departing from the spirit or scope of the invention as defined in the following claims.

The invention claimed is:

1. A method for liquefying a natural gas feed stream to produce an LNG product, the method comprising:

(a) providing a plurality of heat exchanger sections, each of the heat exchanger sections having a warm side and a cold side, and passing a first natural gas feed stream through and cooling the first natural gas feed stream in the warm side of some or all of a plurality of heat exchanger sections so as to precool and liquefy the first natural gas feed stream, the plurality of heat exchanger sections comprising a first heat exchanger section in which a first natural gas stream is precooled and a second heat exchanger section in which the precooled first natural gas stream from the first heat exchanger section is liquefied to form a first liquefied natural gas stream;

(b) flashing the first liquefied natural gas stream withdrawn from the second heat exchanger section to form a flash gas and an LNG product, and separating the flash gas from the LNG product so as to form a flash gas stream and an LNG product stream;

(c) compressing the flash gas stream and recycling the compressed flash gas back into the first natural gas feed stream;

(d) circulating a refrigerant, comprising methane, in a refrigeration circuit comprising the plurality of heat exchanger sections, a compressor train comprising a plurality of compressors and/or compression stages and one or more intercoolers and/or aftercoolers, a first turbo-expander and a second turbo-expander, wherein the circulating refrigerant provides refrigeration to each of the plurality of heat exchanger sections and thus cooling duty for precooling and liquefying the first natural gas feed stream, and wherein circulating the refrigerant in the refrigerant circuit comprises the steps of:

(i) splitting a compressed and cooled gaseous stream of the refrigerant to form a first stream of cooled gaseous refrigerant and a second stream of cooled gaseous refrigerant;

(ii) expanding the first stream of cooled gaseous refrigerant down to a first pressure in the first turbo-expander to form a first stream of expanded cold refrigerant at a first temperature and said first pressure, the first stream of expanded cold refrigerant being a gaseous or predominantly gaseous stream containing no or substantially no liquid as it exits the first turbo-expander;

(iii) passing the second stream of cooled gaseous refrigerant through and cooling the second stream of cooled gaseous refrigerant in the warm side of at least one of the plurality of heat exchanger sections, so as to further cool the second stream of cooled gaseous refrigerant;

(iv) expanding the further cooled second stream of cooled gaseous refrigerant down to a second pressure in the second turbo-expander to form a second stream of expanded cold refrigerant at a second temperature and said second pressure, the second stream of expanded cold refrigerant being a gaseous or predominantly gaseous stream containing no or substantially no liquid as it exits the second turbo-expander, the second pressure being lower than the first pressure and the second temperature being lower than the first temperature;

(v) passing the first stream of expanded cold refrigerant through and warming the first stream of expanded cold refrigerant in the cold side of at least one of the plurality of heat exchanger sections, comprising at least the first heat exchanger section and/or a heat exchanger section in which all or part of the second stream of cooled gaseous refrigerant is cooled, and passing the second stream of expanded cold refrigerant through and warming the second stream of expanded cold refrigerant in the cold side at least one of the plurality of heat exchanger sections, comprising at least the second heat exchanger section, wherein the first and second streams of expanded cold refrigerant are kept separate and not mixed in the cold sides of any of the plurality of heat exchanger sections, the first stream of expanded cold refrigerant being warmed to form a first stream of warmed gaseous refrigerant and the second stream of expanded cold refrigerant being warmed to form a second stream of warmed gaseous refrigerant; and (vi) introducing the first stream of warmed gaseous refrigerant and the second stream of warmed gaseous refrigerant into the compressor train, whereby the second stream of warmed gaseous refrigerant is introduced into compressor train at a different, lower pressure location of the compressor train than the first stream of warmed gaseous refrigerant, and compressing, cooling and combining the first stream of warmed gaseous refrigerant and second stream of warmed gaseous refrigerant to form the compressed and cooled gaseous stream of the refrigerant that is split in step (i).

2. The method of claim 1, wherein the refrigerant comprises at least 85 mole % methane.

3. The method of claim 1, wherein the first stream of expanded cold refrigerant has a vapor fraction of equal to or greater than 0.8 as it exits the first turbo-expander, and wherein the second stream of expanded cold refrigerant has a vapor fraction of equal to or greater than 0.8 as it exits the second turbo-expander.

4. The method of claim 1, wherein the pressure ratio of the first pressure to the second pressure is from 1.5:1 to 2.5:1.

5. The method of claim 1, wherein the first liquefied natural gas stream is withdrawn from the second heat exchanger at a temperature of −100to −145° C.

6. The method of claim 1, wherein the first liquefied natural gas stream is withdrawn from the second heat exchanger at a temperature of −110to −145° C.

7. The method of claim 1, wherein the refrigeration circuit is a closed-loop refrigeration circuit.

8. The method of claim 1, wherein the method further comprises recovering cold from the flash gas stream, prior to compressing the flash gas stream and recycling the compressed flash gas, by passing the flash gas stream through and warming the flash gas stream in the cold side of a flash gas heat exchanger section.

9. The method of claim 8, wherein the flash gas heat exchanger section is not one of the plurality of heat exchanger sections of the refrigeration circuit that are provided with refrigeration by the circulating refrigerant.

10. The method of claim 8, wherein the method further comprises:

(e) passing a second natural gas feed stream through and cooling and liquefying the second natural gas feed stream in the warm side of the flash gas heat exchanger section so as to form a second liquefied natural gas stream; and (f) flashing the second liquefied natural gas stream withdrawn from the flash gas heat exchanger section to form additional flash gas and additional LNG product, and separating the additional flash gas from the additional LNG product so as to provide additional flash gas for the flash gas stream and additional LNG product for the LNG product stream.

11. The method of claim 10, wherein in steps (b) and (f) the separation of the flash gas and additional flash gas from the LNG product and additional LNG product takes place by introducing the flashed first liquefied natural gas stream and flashed second liquefied natural gas stream into a vapor-liquid separator in which the streams are together separated into a vapor overhead and liquid bottoms, the vapor overhead being withdrawn to form the flash gas stream and the liquid bottoms being withdrawn to form the LNG product stream.

12. The method of claim 1, wherein the second heat exchanger section is a coil wound heat exchanger section comprising a tube bundle having tube-side and a shell side.

13. The method of claim 1, wherein the first heat exchanger section has a cold side that defines a plurality of separate passages through the heat exchanger section, and wherein the first stream of expanded cold refrigerant passes through and is warmed in at least one of said passages through the first heat exchanger section to form the first stream of warmed gaseous refrigerant, and the second stream of expanded cold refrigerant passes through and is warmed in the cold side of the second heat exchanger section and then passes through and is further warmed in at least one or more other of said passages through the first heat exchanger section to form the second stream of warmed gaseous refrigerant.

14. The method of claim 1, wherein wherein the first heat exchanger section is a coil wound heat exchanger section comprising a tube bundle having tube-side and a shell side, the plurality of heat exchanger sections further comprise a third heat exchanger section in which a natural gas stream is precooled and/or in which all or a part of the second stream of cooled gaseous refrigerant is cooled, the first stream of expanded cold refrigerant passes through and is warmed in the cold side of one of the first and third heat exchanger sections to form the first stream of warmed gaseous refrigerant, and the second stream of expanded cold refrigerant passes through and is warmed in the cold side of the second heat exchanger section and then passes through and is further warmed in the cold side of the other of the third and first heat exchanger sections to form the second stream of warmed gaseous refrigerant.

15. A system for liquefying a natural gas feed stream to produce an LNG product, the system comprising:

(a) a refrigeration circuit for circulating a refrigerant that provides refrigeration to each of a plurality of heat exchanger sections and thus cooling duty for precooling and liquefying a first natural gas feed stream, the refrigeration circuit comprising:

the plurality of heat exchanger sections, each of the heat exchanger sections having a warm side and a cold side, the plurality of heat exchanger sections comprising a first heat exchanger section and a second heat exchanger section, wherein the warm side of the first heat exchanger section defines at least one passage therethrough for receiving and precooling a first natural gas stream, wherein the warm side of the second heat exchanger section defines at least one passage therethrough for receiving and liquefying the precooled first natural gas stream from the first heat exchanger section so as to form a first liquefied natural gas stream, and wherein the cold side of each of the plurality of heat exchanger sections defines at least one passage therethrough for receiving and warming an expanded stream of the circulating refrigerant;

a compressor train, comprising a plurality of compressors and/or compression stages and one or more intercoolers and/or aftercoolers, for compressing and cooling the circulating refrigerant, wherein the refrigeration circuit is configured such that the compressor train receives a first stream of warmed gaseous refrigerant and a second stream of warmed gaseous refrigerant from the plurality of heat exchanger sections, the second stream of warmed gaseous refrigerant being received at and introduced into a different, lower pressure location of the compressor train than the first stream of warmed gaseous refrigerant, the compressor train being configured to compress, cool and combine the first stream of warmed gaseous refrigerant and second stream of warmed gaseous refrigerant to form a compressed and cooled gaseous stream of the refrigerant;

a first turbo-expander configured to receive and expand a first stream of cooled gaseous refrigerant down to a first pressure to form a first stream of expanded cold refrigerant at a first temperature and said first pressure;

a second turbo-expander configured to receive and expand a further cooled second stream of cooled gaseous refrigerant down to a second pressure to form a second stream of expanded cold refrigerant at a second temperature and said second pressure, the second pressure being lower than the first pressure and the second temperature being lower than the first temperature;

wherein the refrigeration circuit is further configured so as to:

split the compressed and cooled gaseous stream of the refrigerant from the compressor train to form the first stream of cooled gaseous refrigerant and a second stream of cooled gaseous refrigerant;

pass the second stream of cooled gaseous refrigerant through and cool the second stream of cooled gaseous refrigerant in the warm side of at least one of the plurality of heat exchanger sections, so as to form the further cooled second stream of cooled gaseous refrigerant; and pass the first stream of expanded cold refrigerant through and warm the first stream of expanded cold refrigerant in the cold side of at least one of the plurality of heat exchanger sections, comprising at least the first heat exchanger section and/or a heat exchanger section in which all or part of the second stream of cooled gaseous refrigerant is cooled, and pass the second stream of expanded cold refrigerant through and warm the second stream of expanded cold refrigerant in the cold side at least one of the plurality of heat exchanger sections, comprising at least the second heat exchanger section, wherein the first and second streams of expanded cold refrigerant are kept separate and not mixed in the cold sides of any of the plurality of heat exchanger sections, the first stream of expanded cold refrigerant being warmed to form the first stream of warmed gaseous refrigerant and the second stream of expanded cold refrigerant being warmed to form the second stream of warmed gaseous refrigerant;

(b) a pressure reducing device configured to receive the first liquefied natural gas stream from the second heat exchanger section of the plurality of heat exchanger sections and flash the first liquefied natural gas stream to form a flash gas and an LNG product;

(c) a vapor-liquid separator configured to separate the flash gas from the LNG product so as to form a flash gas stream and an LNG product stream; and (d) a flash gas compressor for receiving and compressing the flash gas stream and recycling the compressed flash gas back into the first natural gas feed stream.

16. A system according to claim 15, wherein the system further comprises:

(e) a flash gas heat exchanger section for recovering cold from the flash gas stream prior to the flash gas stream being received and compressed by the flash gas compressor, the flash gas heat exchanger section having a warm side and a cold side, wherein the cold side defines one or more passages therethrough for receiving and warming the flash gas stream.

17. A system according to claim 16, wherein the warm side of the flash gas heat exchanger defines one or more passages therethrough for receiving, cooling and liquefying a second natural gas feed stream so as to form a second liquefied natural gas stream.

18. A system according to claim 17, wherein the system further comprises:

(e) a pressure reducing device configured to receive the second liquefied natural gas stream from the flash gas heat exchanger and flash the second liquefied natural gas stream to form additional flash gas and additional LNG product; and wherein the vapor-liquid separator is configured to separate also the additional flash gas from the additional LNG product so as to provide additional flash gas for the flash gas stream and additional LNG product for the LNG product stream.

* * * * *